US006078318A

United States Patent [19]

Mori et al.

[11] Patent Number: 6,078,318

[45] Date of Patent: Jun. 20, 2000

[54] DATA TRANSFER METHOD, DISPLAY DRIVING CIRCUIT USING THE METHOD, AND IMAGE DISPLAY APPARATUS

[75] Inventors: Hideo Mori; Kenzo Ina, both of Yokohama; Atsushi Mizutome, Kanagawa-ken; Kazuhiko Murayama, Atsugi, all of Japan

[73] Assignee: Canon Kabushiki Kaisha, Tokyo, Japan

[21] Appl. No.: 08/636,496

[22] Filed: Apr. 23, 1996

[30] Foreign Application Priority Data

| | | | |
|---|---|---|---|
| Apr. 27, 1995 | [JP] | Japan | 7-125632 |
| Apr. 27, 1995 | [JP] | Japan | 7-125633 |
| May 1, 1995 | [JP] | Japan | 7-128771 |
| May 2, 1995 | [JP] | Japan | 7-131183 |
| May 8, 1995 | [JP] | Japan | 7-132643 |

[51] Int. Cl.[7] ..... G09G 3/36; G09G 5/00

[52] U.S. Cl. ..... 345/204; 345/98; 345/516

[58] Field of Search ..... 345/98–103, 204–206, 345/516, 517

[56] References Cited

U.S. PATENT DOCUMENTS

| | | | |
|---|---|---|---|
| 4,575,721 | 3/1986 | Delgrange et al. | 340/776 |
| 4,707,802 | 11/1987 | Takahashi | 364/900 |
| 4,922,241 | 5/1990 | Inoue et al. | 340/784 |
| 5,029,984 | 7/1991 | Adachi et al. | 350/334 |
| 5,303,201 | 4/1994 | Sakamoto | 365/236 |
| 5,345,250 | 9/1994 | Inoue et al. | 345/100 |
| 5,359,344 | 10/1994 | Inoue et al. | 345/100 |
| 5,444,458 | 8/1995 | Ishikawa | 345/98 |
| 5,481,651 | 1/1996 | Herol | 345/100 |
| 5,548,559 | 8/1996 | Mochizuki et al. | 365/230.08 |
| 5,703,616 | 12/1997 | Kawasugi | 345/98 |
| 5,734,378 | 3/1998 | Okada et al. | 345/204 |
| 5,828,367 | 10/1998 | Kuga | 345/98 |

FOREIGN PATENT DOCUMENTS

| | | |
|---|---|---|
| 0 186 540 | 7/1986 | European Pat. Off. . |
| 0 446 002 | 9/1991 | European Pat. Off. . |
| 0 640 950 | 3/1995 | European Pat. Off. . |
| 3-96997 | 4/1991 | Japan . |
| 2 255 668 | 11/1992 | United Kingdom . |

*Primary Examiner*—Amare Mengistu
*Assistant Examiner*—David L. Lewis
*Attorney, Agent, or Firm*—Fitzpatrick, Cella, Harper & Scinto

[57] ABSTRACT

A data transfer method transfers data to an information-side driver for driving a display apparatus. Wherein, driver circuits each comprise chip address/video data discrimination circuit and a unit driver are mounted around the display apparatus. A unique chip address is set for each of the unit drivers by a hardware pattern. Data exchange with the driver circuits is performed so that chip address information and video data information are time-divisionally transferred to the target unit driver using a chip address/video data common bus line and a chip address/video data discrimination control signal.

84 Claims, 30 Drawing Sheets

| BS0 | BS1 | BS2 | AS | OUTPUT PIN FOR DATA TRANSMISSION AND RECEIVING |
|---|---|---|---|---|
| 0 | 0 | 0 | 0 | 0—31 |
| 0 | 0 | 1 | 0 | 32—63 |
| 0 | 1 | 0 | 0 | 64—95 |
| | ⋮ | | | ⋮ |
| 1 | 1 | 0 | 0 | 192—223 |
| 1 | 1 | 1 | 0 | 224—255 |
| × | × | × | 1 | ALL PINS |

| MODE | PA0 | PA1 | PA2 | PA3 | PA4 | PA5 | PA6 | PA7 | OUTPUT PIN SELECTED |
|---|---|---|---|---|---|---|---|---|---|
| 0 | 0 | 0 | 0 | 0 | 0 | 0 | 0 | 0 | 0 |
| | 0 | 0 | 0 | 0 | 0 | 0 | 0 | 1 | 1 |
| | 0 | 0 | 0 | 0 | 0 | 0 | 1 | 0 | 2 |
| | 0 | 0 | 0 | 0 | 0 | 0 | 1 | 1 | 3 |
| | ⋮ | | | | | | | | |
| 1 | 0 | 0 | 0 | 0 | 0 | 0 | 0 | × | 0, 1 |
| | 0 | 0 | 0 | 0 | 0 | 0 | 1 | × | 2, 3 |
| | 0 | 0 | 0 | 0 | 0 | 1 | 0 | × | 4, 5 |
| | 0 | 0 | 0 | 0 | 0 | 1 | 1 | × | 6, 7 |
| | ⋮ | | | | | | | | |

FIG. 34

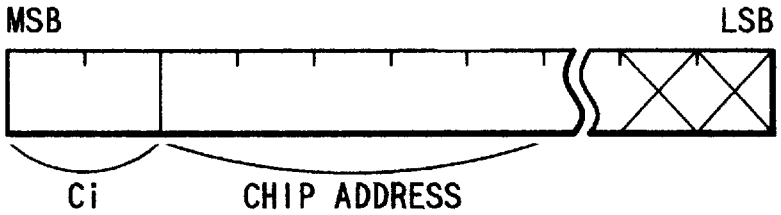

| | COM | SEG |
|---|---|---|
| 00 | PIN ADDRESS | VIDEO DATA |
| 01 | SCANNING MODE INFORMATION | |
| 10 | WAVEFORM DATA INFORMATION | WAVEFORM DATA INFORMATION |
| 11 | | TEST MODE INFORMATION |

FIG. 36

| OUTPUT VOLTAGE LEVEL SET DATA SELECTED IN SECOND SINGLE HORIZONTAL SCANNING PERIOD (EFFECTIVE ONLY AT DOUBLE SCANNING) | | OUTPUT VOLTAGE LEVEL SET DATA SELECTED IN FIRST SINGLE HORIZONTAL SCANNING PERIOD | | |
|---|---|---|---|---|
| CWFD3 | CWFD2 | CWFD1 | CWFD0 | OUTPUT VOLTAGE LEVEL |
| 0 | 0 | 0 | 0 | VC |
| 0 | 1 | 0 | 1 | V1 |
| 1 | 0 | 1 | 0 | V2 |
| 1 | 1 | 1 | 1 | V5 |

| *STEST1 | *STEST0 | OPERATION MODE |
|---|---|---|
| 1 | 1 | NORMAL OPERATION STATE |
| 1 | 0 | TEST MODE, ALL CHANNEL V4 OUTPUT |
| 0 | 1 | TEST MODE, ALL CHANNEL V3 OUTPUT |
| 0 | 0 | NO DECIDE |

DATA TRANSFER METHOD, DISPLAY DRIVING CIRCUIT USING THE METHOD, AND IMAGE DISPLAY APPARATUS

BACKGROUND OF THE INVENTION

1. Field of the Invention

The present invention relates to a data transfer method used in a display apparatus driving circuit for driving a display apparatus such as a flat display and, more particularly, to an improved data transfer method for a driving integrated circuit, which can reduce the average data transfer amount.

2. Related Background Art

Conventionally, data for one line must be transferred to a driving circuit of a flat display (to be referred to as an FPD hereinafter: Flat Panel Display) since the display operation on the FPD is performed by a line or dot sequential method. More specifically, in a conventional display, all the bits of display data must be transferred in synchronism with the frame frequency. Also, driving data of a driving integrated circuit is updated each time display data is transferred.

FIG. 1 is a physical schematic diagram showing the conventional data transfer method. The system shown in FIG. 1 includes a display apparatus (panel) 1, information line side driving integrated circuits (segment drivers) 2, segment bus boards 5, data buses 7, clock signal lines 8, serial data input signal lines 9, and a controller 10.

FIG. 2 is a schematic diagram of the segment drivers 2 in the conventional data transfer method shown in FIG. 1. The video data buses 7 for supplying video data ID0 to ID7 and the clock signal line 8 for supplying clocks (CLK) are connected in parallel with the segment drivers 2 (2-1, 2-2, 2-3, . . . ), and the serial data input signal (CSDi) line 9 is cascade-connected to these drivers 2. The first segment driver 2-1 receives a serial data input signal CSDi from the controller 10. A serial data output signal a output from the first segment driver 2-1 is connected to the serial data input pin of the second segment driver 2-2, and a serial data output signal b output from the second segment driver 2-2 is connected to the serial data input pin of the third segment driver 2-3.

FIG. 3 is a timing chart in the conventional data transfer method shown in FIG. 1. FIG. 4 is a block diagram showing the arrangement of the driver in the conventional data transfer method shown in FIG. 1.

The conventional data transfer method will be explained below with reference to FIGS. 1 to 4. As shown in FIG. 3, segment image data (video data) for all the drivers are serially transferred in an 8-bit width, and when first data, i.e., D0 to D7, of these image data are supplied, the serial data input signal CSDi simultaneously changes to "1". Then, the first segment driver 2-1 shown in FIG. 2 begins to latch the input image data and simultaneously begins to count the number of clocks. When the segment driver 2-1 has counted 20 clocks CLK, it completes the data input operation, and sets the serial data output signal a to be "1". Similarly, the second and third segment drivers receive image data in the same procedure as described above. With this operation, data D0 to D159 are received as image data of the first segment driver, data D160 to D319 are received as image data of the second segment driver, and data D320 to D479 are received as image data of the third segment driver, thus completing the transfer operation of image data for one horizontal scanning period.

However, in the above-mentioned prior art, since each driving integrated circuit has neither a latch memory nor a multiplexer circuit, sequentially transferred data are latched by a required amount (corresponding to the data holding performance of the integrated circuit), or data corresponding to a sub-scanning width are sequentially transferred using n driving integrated circuits via a shift register to form 1-line data.

Therefore, in the conventional data transfer method, even when a display apparatus with memory characteristics such as a ferroelectric liquid crystal display (to be referred to as an FLCD hereinafter: Ferroelectric Liquid Crystal Display) is to be driven, data for one line are transferred.

SUMMARY OF THE INVENTION

An object of the present invention is to provide a display apparatus wherein two kinds of informations are transmitted through a common bus in time series.

Another object of the present invention is to provide a display apparatus which can recognize an arrangement position even in case of using the same curcuit structure of IC.

The present invention has been made in consideration of the conventional problems, and has as its object to reduce the average data transfer amount from a controller to drivers in a display apparatus driving circuit. By reducing the data transfer amount, consumption power and radiation noise are expected to be reduced.

In order to achieve the above object, according to the present invention, in a data transfer method for transferring data to information-side drivers for driving a display apparatus, driver circuits each comprising a chip address/video data discrimination circuit and a unit driver are mounted around the display apparatus, each unit driver is set with its own chip address by means of a hardware pattern, and data exchange with the driver circuits is performed, so that chip address information and video data information are time-divisionally transferred to the target unit driver by utilizing a chip address/video data common bus line and a chip address/video data discrimination control signal.

According to a preferred embodiment of the present invention, the display apparatus comprises a flat display. Each driver circuit comprises an integrated circuit having the chip address/video data discrimination circuit and one unit driver. The unit driver comprises a chip address terminal consisting of a plurality of pins, which are used for setting its own address. Each unit driver comprises a latch means for holding previous data until it receives new data, and outputting data in accordance with the held data, and transfers data of only the unit driver whose video data has changed. In this case, the output pins of each unit driver are divided into a plurality of blocks, and data of only blocks whose video data have changed are transferred. Alternatively, only data between output pin blocks designated by start and end block signals of the output pins of each unit driver are transferred.

According to the present invention, when, for example, a segment-side driving integrated circuit comprises a latch circuit, a multiplexer circuit, and a chip address discrimination circuit to realize a data transfer method with control data, only changed data are transferred to the driving integrated circuit, thus reducing the average data transfer amount. More specifically, the driving integrated circuits for the flat display are mounted around the panel, and data exchange with the integrated circuits is performed so that a controller outputs data with address information and control information (driver output block information/start block information/end block information) to a target driving integrated circuit. In this manner, the integrated circuit can receive target data on the basis of the address information and the control information. Therefore, the controller designates only a position where data has changed and outputs the data thereto, thereby realizing the above-mentioned concept.

In the prior art, since chip select signals are required in units of chips, a large-screen, high-resolution display which is expected to be developed in future suffers an increase in the number of scanning lines, and the number of drivers increases accordingly, resulting in an increase in the number of signal lines.

According to an embodiment of the present invention, there is provided a data transfer method which can reduce the number of signal lines between a controller and drivers in a display apparatus driving circuit and has a predetermined number of signal lines independently of the resolution of a display apparatus.

According to another embodiment of the present invention, as scanning-side drivers for driving a display apparatus, unit drivers each comprising a chip address/pin address discrimination circuit are mounted around the display apparatus, each unit driver is set with its own chip address by means of a hardware pattern, and data exchange with the unit drivers is performed so that chip address information and pin address information are time-divisionally transferred to a target integrated circuit by utilizing a chip address/pin address common bus line and a chip address/pin address discrimination control signal.

In a preferred embodiment of the present invention, the display apparatus comprises a flat display. Each unit driver comprises a one-chip IC, which has a chip address terminal consisting of a plurality of pins. The chip address information is supplied to each driver by one or two clocks.

According to the embodiment of the present invention, integrated circuits each comprising, e.g., a chip address/pin address discrimination circuit are mounted around a flat display panel, each integrated circuit is set with its own chip address by means of a hardware pattern, and data exchange with the integrated circuits is performed so that chip address information and pin address information is time-divisionally transferred to a target driving integrated circuit by utilizing a bus line arranged around the panel. In this manner, the number of signal lines between a controller and drivers can be reduced, and the present invention can be applied to a panel having a higher resolution (a larger number of scanning lines) without increasing the number of signal lines between the controller and drivers.

In the prior art, as for the common side (scanning side), data are transferred by a method different from that for the segment side without using a common data line, and the controller must independently output segment data and common data, thus requiring a larger number of signal lines.

According to an embodiment of the present invention, the number of signal lines between the controller and drivers in a display apparatus driving circuit can be reduced, the number of signal lines does not depend on the resolution of a display apparatus, and the average data transfer amount from the controller to the drivers can be reduced.

For this purpose, according to the present invention, in a data transfer method for transferring data to drivers for driving a display apparatus, scanning-side drivers and information-side drivers are mounted around the display apparatus, and data transfer to the scanning- and information-side drivers is performed using a common bus line which transfers information to both the scanning- and information-side drivers.

According to a preferred embodiment of the present invention, the display apparatus comprises a flat display. Each of the scanning- and information-side drivers comprises one or a plurality of one-chip integrated circuits, and each integrated circuit is set with its own chip address by means of a hardware pattern. For example, each integrated circuit comprises a chip address terminal consisting of a plurality of pins, and its chip address is set by fixing the respective pins to ground (GND) or VCC. Information to each scanning-side driver consists of chip address information and pin address information, and information to each information-side driver consists of chip address information and video data information. Each information-side driver has a data latch means for latching previous data until it receives new data, and outputting data in accordance with the held data. A controller transfers data of only the drivers whose video data have changed. The drivers are arranged at the four corners of the display apparatus, and the common bus is formed into a ring pattern.

According to an embodiment of the present invention, for example, each of segment-side driving integrated circuits comprises a latch circuit, a multiplexer circuit, and a chip address discrimination circuit, a common bus is used as segment/common lines, and data to be output from a controller have a common format so as to realize a data transfer method with control data, thereby reducing the number of signal lines between the controller and driving integrated circuits. At the same time, the controller transfers only changed data to the driving integrated circuits (in particular, segment-side ICs), thereby reducing the average data transfer amount. This method is particularly effective for a high-resolution display. More specifically, since driving integrated circuits for a flat display are mounted around the panel and data exchange with the integrated circuits is performed so that the controller outputs data with address information and control information to a target driving integrated circuit by utilizing a bus line arranged around the panel, the integrated circuit can receive target data on the basis of the address information and the control information. Therefore, the controller can designate only a position (arbitrary segment and common pin addresses) where data has changed and can output data thereto, thus realizing the above-mentioned concept.

In each conventional scanning-side driver, a pin address signal, a chip select signal, a waveform information signal, a mode set signal, and the like are transferred using independent signal lines. In each information-side driver, a video data signal, a waveform information signal, a test mode signal, and the like are transferred using independent signal lines. For this reason, the number of signal lines increases, resulting in an increase in cost and an increase in unnecessary radiation noise.

Since no latch memory for output control information is arranged, and an output control information signal line is connected in parallel with a plurality of drivers, identical waveform information can only be set in all the drivers.

Furthermore, since scanning- and information-side signals have independent signal formats, the number of signal lines further increases.

An embodiment of the present invention has been made in consideration of the conventional problems, and has as its object to reduce the number of signal lines that connect a controller and scanning- or information-side drivers to attain a cost reduction and a reduction of unnecessary radiation noise, and to transfer waveform information and the like in units of a plurality of drivers.

In this embodiment, data to be output from the controller to each scanning-side/information-side driver has a common data format, and chip address information, pin address information, waveform information, and mode set information for the scanning-side drivers, chip address information, video data information, waveform information, and test mode information for the information-side drivers, and control data for discriminating such information are time-divisionally transferred using a common bus.

With the above-mentioned data transfer method, the number of signal lines between the controller and drivers can be reduced, and at the same time, waveform information and mode set information can be independently transferred in units of drivers.

FIG. 5 shows the arrangement of a conventional matrix type display apparatus to which the above embodiment is to be applied. Referring to FIG. 5, the apparatus comprises a display unit 401 for displaying an image, driving circuits 402 for driving the scanning lines of the display unit 401, driving circuits 403 for driving the information lines of the display unit 401, a bus board 404 for supplying a power supply signal and a control signal to the driving circuits 402, a bus board 405 for supplying a power supply signal and a control signal to the driving circuits 403, a control means (to be referred to as a controller hereinafter) 406 for generating the power supply signals and control signals to be supplied to the driving circuits 402 and 403, a cable 407 for supplying the power supply signal and control signal generated by the controller 406 to the bus board 404, and a cable 408 for supplying the power supply signal and control signal generated by the controller 406 to the bus board 405.

The controller 406 determines the operations of the driving circuits 402 and 403 required for drawing an intended image on the basis of image information transferred from a computer or the like, and transfers data to the bus boards 404 and 405. More specifically, the controller 406 supplies control signals and power supply signals required for displaying the image to the bus boards 404 and 405 via the cables 407 and 408. The driving circuits 402 and 403 receive the control signals and power supply signals associated with the operations from the bus boards 404 and 405, and perform predetermined operations.

FIG. 6 shows the arrangement of general driving circuits. The same reference numerals denote the same parts as in FIG. 5, and a detailed description thereof will be omitted. Referring to FIG. 6, a data bus 409 transfers image data transferred from the controller 406. A clock signal line 410 supplies a clock signal for attaining synchronization of the reception timings of image data from the image data bus 409 to the driving circuits 403 and a clock signal for attaining synchronization of the operation timings in the driving circuits, i.e., for attaining synchronization of the operation timings of clock counters and latch circuits (to be described later). A chip select (to be abbreviated as CS hereinafter) signal line 411 supplies a CS signal for designating a driving circuit which is to receive image data. A drive signal line 412 supplies a drive signal used for simultaneously outputting image data to the display unit after image data for one line are received by all the driving circuits 403.

In the above-mentioned arrangement of the driving circuits, the number of CS signal lines for designating driving circuits which are to receive image data increases when the number of driving circuits increases upon realization of a large-screen or high-resolution display, and consequently, the number of control signals to be transferred from the controller increases. The increase in the number of control signals must be avoided as much as possible since it leads to an increase in unnecessary radiation noise.

This embodiment has been made to solve the above-mentioned problem, and provides a means for transferring image data to the respective driving circuits without increasing the number of control signals to be output from the controller, which problem arises upon an increase in the number of driving circuits.

In order to solve the above-mentioned problem, an image display apparatus of this embodiment comprises a display unit for displaying an image, driving circuits for driving the display unit, a bus board for supplying a power supply signal and a control signal to the driving circuits, a control means for generating the power supply signal and the control signal to be supplied to the driving circuits, and a transmission means for supplying the power supply signal and the control signal generated by the control means to the bus board. Data obtained by adding a signal, which indicates the start of transfer, to the beginning of image data transferred from the control means is transferred to the driving circuits, and each driving circuit comprises a circuit for recognizing its mounting position on the basis of a hardware pattern on the bus board.

According to this embodiment, even when the number of driving circuits increases, image data can be sequentially received in units of driving circuits without increasing the number of control signal lines, and the controller need not supply any chip select (CS) signal, thus obtaining an effect of suppressing unnecessary radiation noise, and the like.

BRIEF DESCRIPTION OF THE DRAWINGS

FIG. 34 is a view showing the format of a data discrimination signal in the circuit shown in FIG. 29;

FIG. 36 is a correspondence table showing the relationship between the combination of waveform information signals and the output voltage in a scanning-side driver in a conventional data transfer method;

DETAILED DESCRIPTION OF THE PREFERRED EMBODIMENTS

One preferred embodiment of the present invention is a display apparatus which adopts a data transfer method for supplying a driving circuit selection signal to driving circuits via a common bus.

Together with the driving circuit selection signal (chip address) supplied via the common bus, a scanning line selection signal (pin address) and display data (video data) can be time-serially supplied via the same bus. Furthermore, additional information such as intra-chip block selection information, scanning mode information, waveform data information, test mode information, and the like can be supplied via the same bus.

Another preferred embodiment of the present invention adopts a data transfer method for transferring the pin address and video data to driving circuits via a common bus.

Of course, the chip address and additional information can be sent via the same bus.

On the other hand, a control signal for identifying various kinds of information is supplied to the driving circuits via a line different from the above-mentioned bus.

Figure 42:
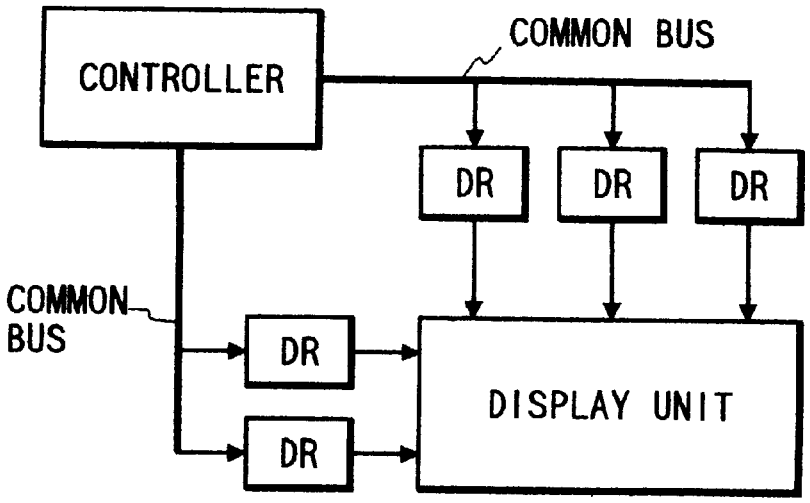
FIGS. 42 and 43 show display apparatuses using a data transfer method according to the present invention.

FIG. 42 is a block diagram of a display apparatus according to the above-mentioned embodiment.

Each driving circuit DR time-serially receives various kinds of information output from a controller via a common bus. When a control signal synchronous with the information to be transferred is supplied via a control line (not shown), the kind of information to be transferred via the common bus can be discriminated.

Figure 43:
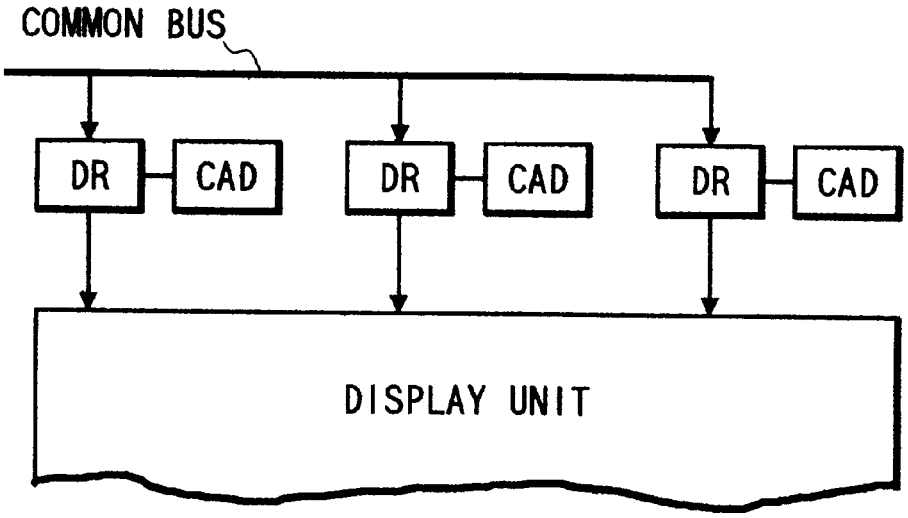

In another embodiment of the present invention, as shown in FIG. 43, each driving circuit comprises a means CAD for specifying the position information of the driving circuit.

The means CAD is preferably constituted by an outer circuit of IC chips of the driving circuits DR, so that the driving circuits DR can use IC chips having the same circuit arrangement. Such outer circuit can be easily manufactured by, e.g., a wiring pattern formed on a common bus board.

The driving circuit preferably uses a tape-carrier-packaged IC, and a common wiring board that presents the bus preferably uses a multi-layered printed wiring board.

As a display unit used in the present invention, an active matrix type liquid crystal element, a plasma display, an electron emission element, a ferroelectric liquid crystal element, and a digital micro-mirror device may be used.

The preferred embodiments of a display apparatus which adopts the data transfer method of the present invention will be described in detail hereinafter.

Figure 7:
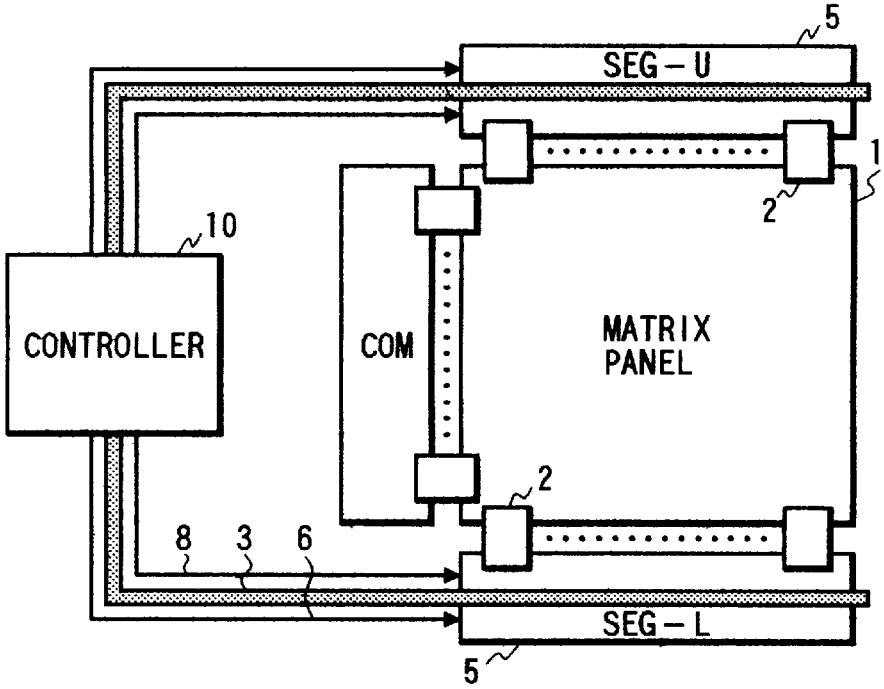
FIG. 7 is a physical schematic diagram showing a data transfer method according to the first embodiment of the present invention.
Figure 8:
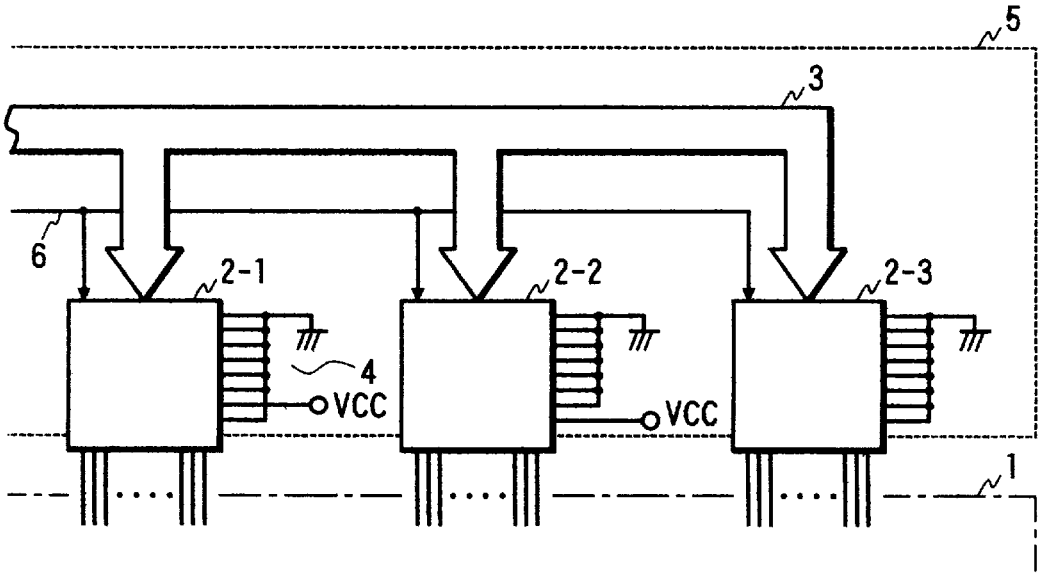
FIG. 8 is a schematic diagram showing a method of assigning chip addresses in a hardware manner in the first embodiment of the present invention.
Figures 9, 12:
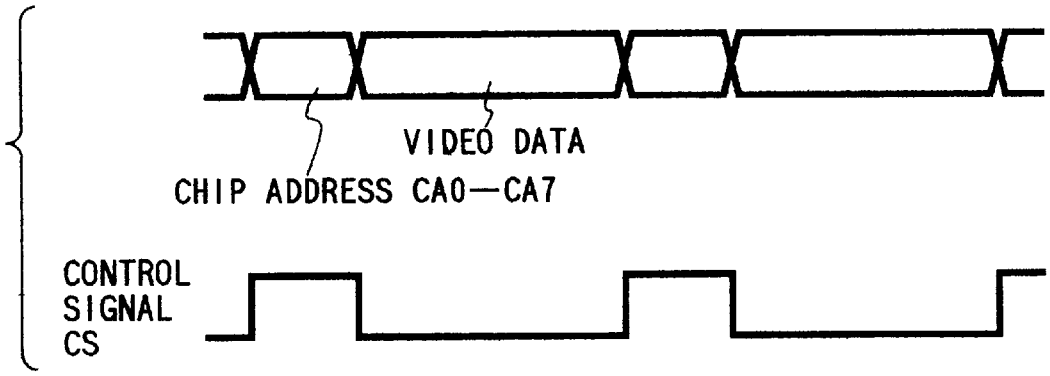
FIG. 9 is a schematic chart showing the data transfer method according to the first embodiment of the present invention.
FIG. 12 is a table showing the block division method in the data transfer method according to the first embodiment of the present invention.
Figure 10:
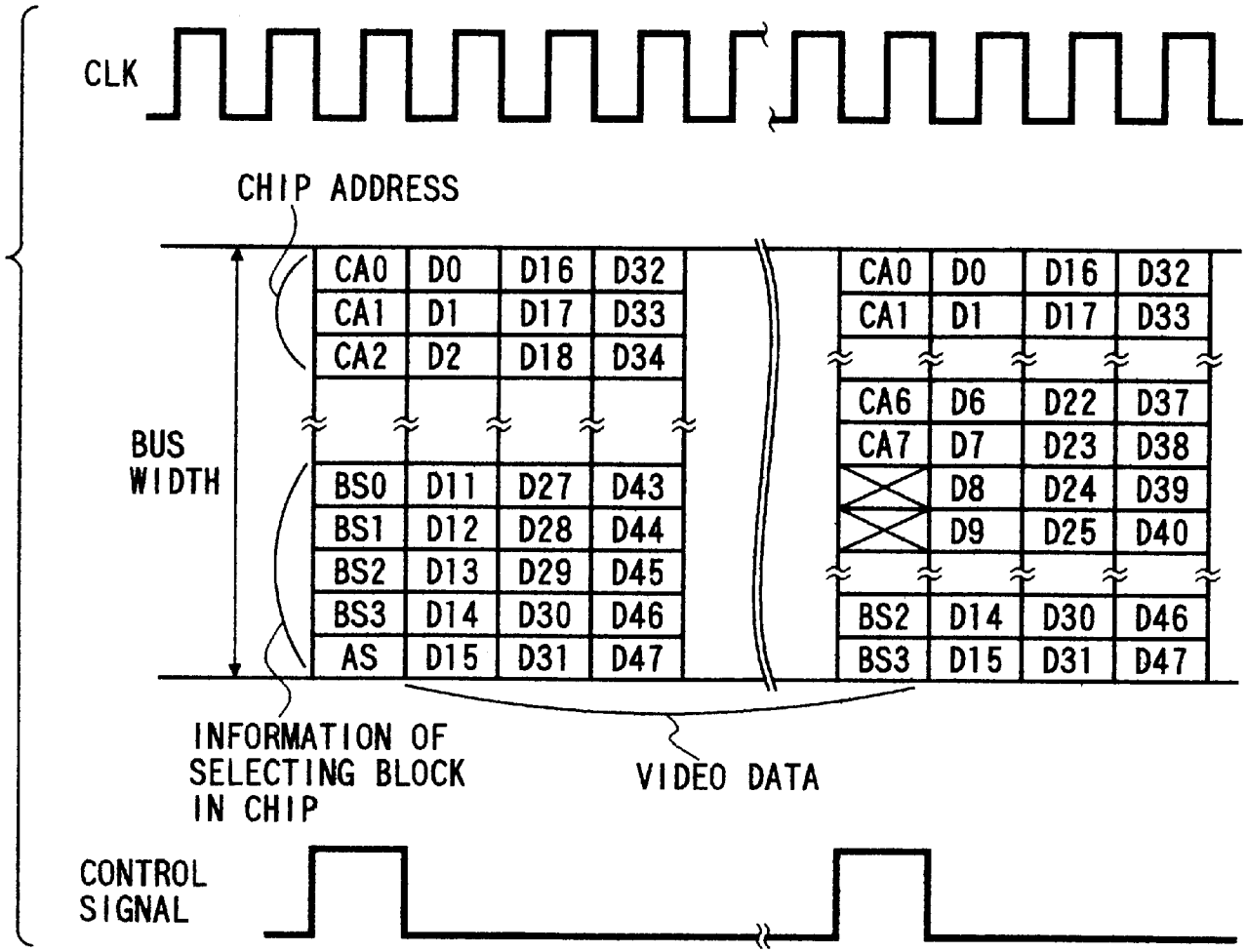
FIG. 10 is a timing chart showing the data transfer method according to the first embodiment of the present invention.
Figure 11:
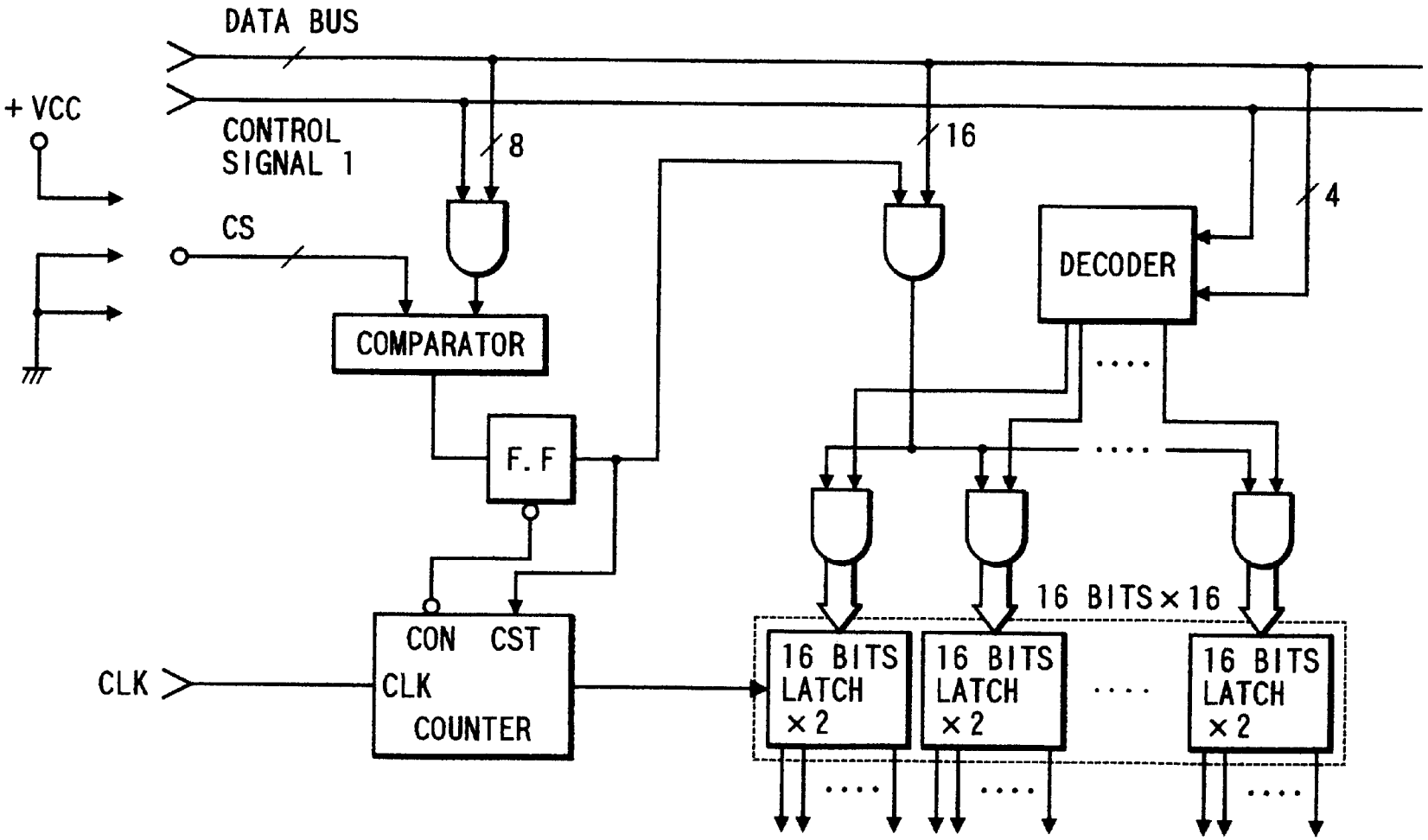
FIG. 11 is a circuit diagram showing the arrangement of a segment driver according to the first embodiment of the present invention.

FIG. 7 is a physical schematic diagram showing the data transfer method for a display apparatus driving circuit according to a first embodiment of the present invention (the common-side data transfer is not shown). FIG. 8 is a schematic diagram showing the method of fixing chip addresses of segment drivers 2 in FIG. 7 in a hardware manner. Referring to FIGS. 7 and 8, the driving circuit comprises a display apparatus (FPD) 1, information line-side driving integrated circuits (segment drivers) 2, a common bus 3, chip select terminals 4, a segment bus board 5, a control signal (CS) line 6, a clock signal (CLK) line 8, and a controller 10. FIG. 9 is a schematic chart showing the data transfer method in the circuit shown in FIG. 7. FIG. 10 is a timing chart for explaining in detail information to be received by the segment drivers 2 (2-1, 2-2, 2-3, . . . ) in the circuit shown in FIGS. 7 and 8, i.e., showing the data format on a 16-bit bus and the timing of a control signal. FIG. 11 is a block diagram showing the arrangement of the segment driver in the circuit shown in FIG. 7.

In this embodiment, as shown in FIG. 7, the plurality of drivers 2 for driving the display apparatus 1 are connected via the common bus 3, and a unique chip address is assigned to each driver by fixing a plurality of pins of the chip address terminal 4 to ground (GND, e.g., "0") or VCC (the upper reference potential, e.g., "1") as shown in FIG. 8. The controller 10 time-divisionally outputs chip addresses CA0 to CA7, block select signals BS0 to BS3 and AS, and video data in the data format shown in FIGS. 9 and 10 onto the common bus 3. When a control signal is "1", each driver 2 compares the input chip address signal with its own chip address, which is designated in advance in a hardware manner. When the two addresses match, the driver recognizes that the data following the control signal is information addressed thereto. For example, the first driver 2-1 shown in FIG. 8 is assigned a fixed chip address "0, 0, 0, 0, 0, 0, 1, 0". When the control signal (CS) is "1", and the chip addresses CA0 to CA7 of the information on the bus are "0, 0, 0, 0, 0, 0, 1, 0", the first driver 2-1 recognizes that the information following the control signal is video data to be received by itself. When the block select signal AS of the information on the bus is "0", data according to the combination of the signals BS0 to BS3 are transferred from the controller 10. For example, when the signals BS0 to BS3 are "0, 1, 0, 0", video data for the 64th to 95th output pins corresponding to the second one of blocks obtained by dividing 256 outputs into eight blocks are transferred. On the other hand, when the signal AS is "0", data for all the output pins are transferred independently of the value BS. FIG. 12 is a table showing such block division method.

Each driver 2 holds previous data until it receives new data, and drives the display apparatus 1 in accordance with the held data. Therefore, according to the data transfer method of this embodiment, the controller detects a change in video data, and transfers data corresponding to only the changed portion (in units of drivers) so as to reduce the average data transfer amount, thus contributing to reductions of consumption power and radiation noise. In addition, a driving voltage can be applied to the display apparatus 1 in correspondence with only blocks whose data are updated. The data transfer method of this embodiment is particularly effective for a partial rewrite driving method performed in a device with memory characteristics such as a ferroelectric liquid crystal device, i.e., a method of updating display data in correspondence with only the change point of video data.

Figure 13:
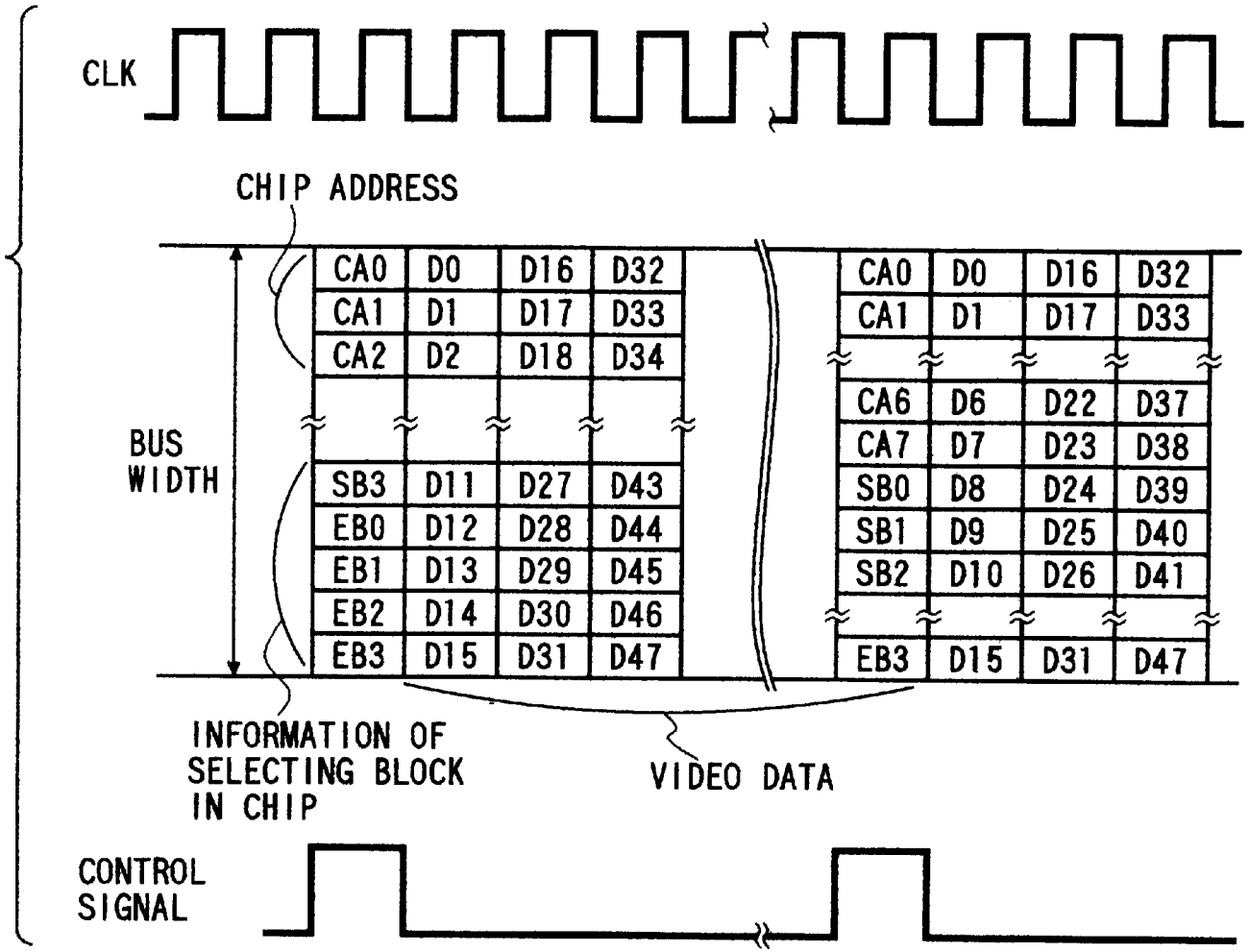
FIG. 13 is a timing chart showing a data transfer method according to the second embodiment of the present invention.
Figure 14:
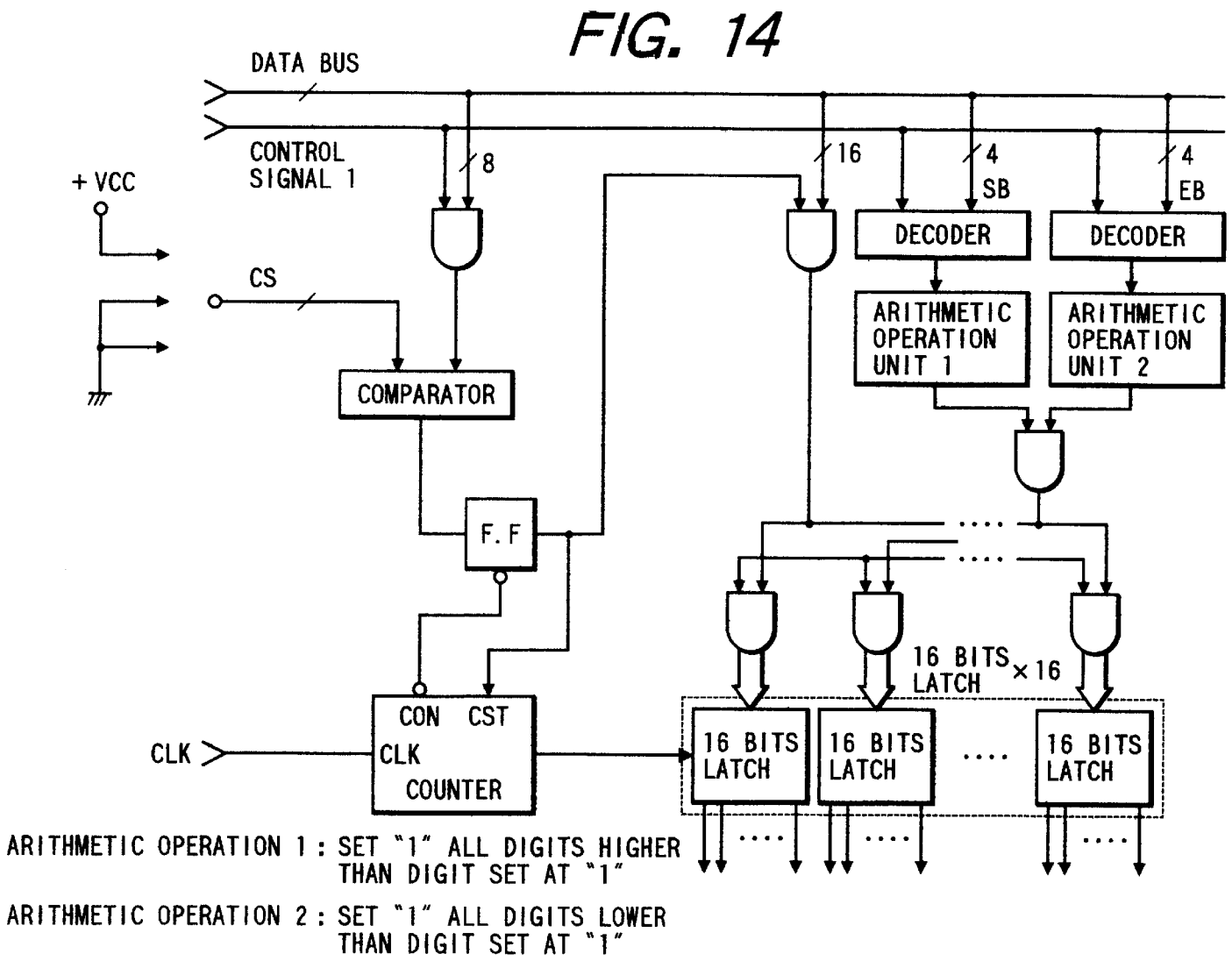
FIG. 14 is a circuit diagram showing the arrangement of a segment driver according to the second embodiment of the present invention.

FIG. 13 is a timing chart showing the data transfer method according to a second embodiment of the present invention. FIG. 14 is a block diagram showing the arrangement of the segment driver to which the data transfer method of the second embodiment is applied. In this embodiment, the respective segment drivers are set with chip addresses, as shown in FIG. 8. Furthermore, the output pins of each segment driver are set with output pin addresses. The controller 10 designates the output pin address that transfers data using start block information signals SB0 to SB3 and end block information signals EB0 to EB3 in addition to the above-mentioned chip address. For example, when the control signal is "1" and the chip addresses CA0 to CA7 of the information on the bus are "0, 0, 0, 0, 0, 0, 1, 0", the first driver 2-1 (see FIG. 8) recognizes that the information following the control signal is information to be received by itself. At this time, when the signals SB0 to SB3 are "0, 0, 0, 0", and the signals EB0 to EB3 are "1, 1, 1, 0", video data from the 0th block, i.e., the 0th output pin to the 14th block, i.e., the 239th output pin are transferred from the controller. Therefore, according to the data transfer method of the second embodiment, data can be transferred by selecting a plurality of continuous blocks in the driver.

As described above, according to the present invention, since each segment-side driving integrated circuit 2 comprises a latch circuit, a multiplexer circuit, and a chip address discrimination circuit to realize a data transfer method with control data, only changed data can be transferred to each driving integrated circuit, thereby reducing the average data transfer amount.

Furthermore, since each driver is divided into a plurality of blocks, the output pin blocks are set with addresses, and data are transferred to only pins designated by start block information and end block information, the average data transfer amount can be further reduced.

Since the average data transfer amount can be reduced, as described above, reductions of consumption power and radiation noise can be attained, and a driving voltage can be applied to the display apparatus 1 in correspondence with only blocks whose data are updated. This method is particularly effective for a partial rewrite driving method performed in a device with memory characteristics such as a ferroelectric liquid crystal device, i.e., a method of updating display data in correspondence with only the change point of video data.

Figure 15:
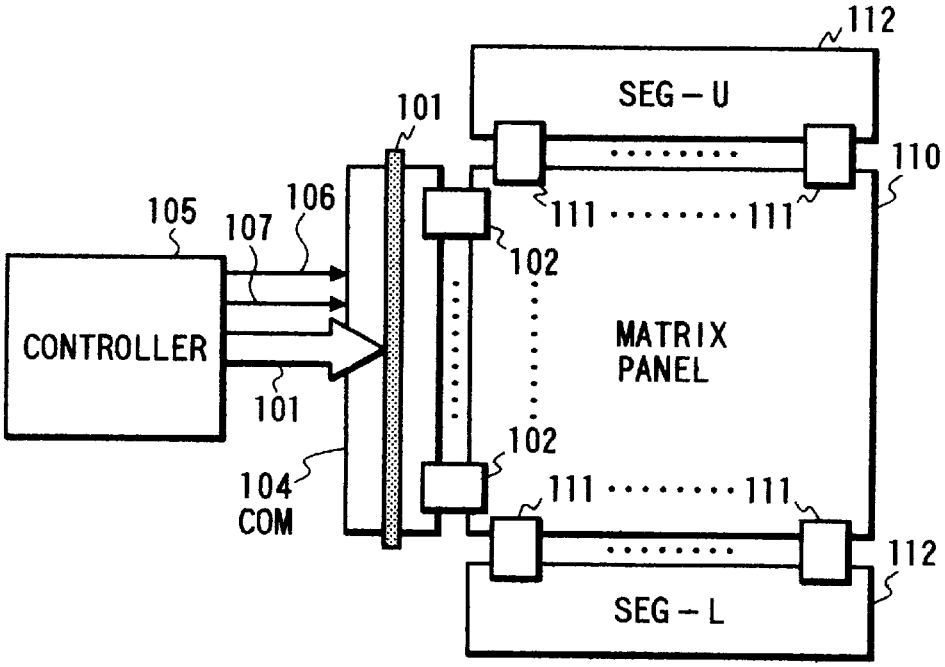
FIG. 15 is a physical schematic diagram showing a data transfer method according to the first embodiment of the present invention.
Figure 16:
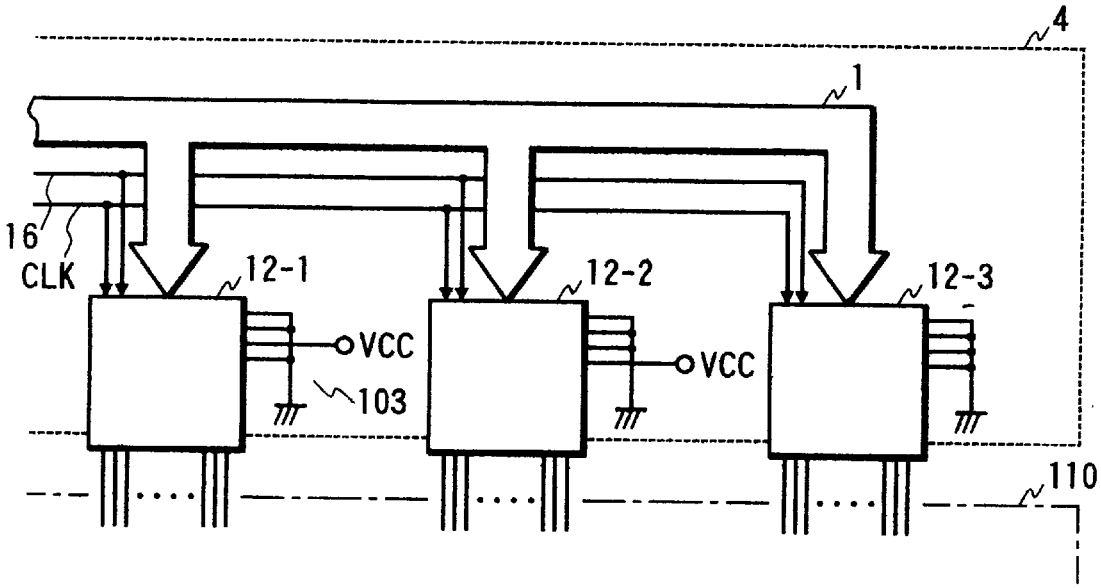
FIG. 16 is a schematic diagram showing the method of assigning chip addresses in a hardware manner in the first embodiment of the present invention.
Figure 17:
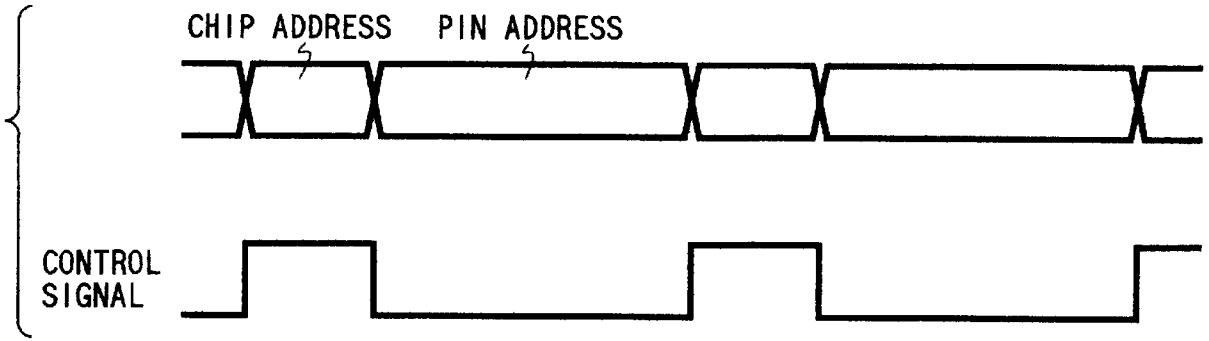
FIG. 17 is a schematic chart showing the data transfer method according to the first embodiment of the present invention.

FIG. 15 is a physical schematic diagram showing the data transfer method for a display apparatus driving circuit according to a third embodiment of the present invention (the segment-side data transfer is not shown). FIG. 16 is a schematic diagram showing the method of setting the chip addresses of the respective unit drivers in the circuit shown in FIG. 15 in a hardware manner. Referring to FIGS. 15 and 16, the circuit comprises a bus 101, scanning-side driving integrated circuits (common drivers) 102, fixed chip address input pins 103, a common bus board 104, a controller 105, a control signal line 106, a clock signal (CLK) line 107, a display apparatus (panel) 110, information-side driving integrated circuits (segment drivers) 111, and a segment bus board 112. FIG. 17 is a schematic chart showing the data transfer method in the circuit shown in FIG. 15.

In this embodiment, as shown in FIG. 15, the controller 108 and the drivers 102 (unit drivers 12-1, 12-2, 12-3, . . . ) for driving the display apparatus 110 are connected via the common bus 101. As shown in FIG. 16, each driver 102 is assigned a unique chip address by fixing the plurality of chip address input pins (terminals) 103 to ground (GND: corresponding to, e.g., "0") or VCC (the upper reference potential: corresponding to, e.g., "1") on the printed board 104. The controller time-divisionally transfers the chip and pin addresses in the data format shown in FIG. 17.

Figure 18:
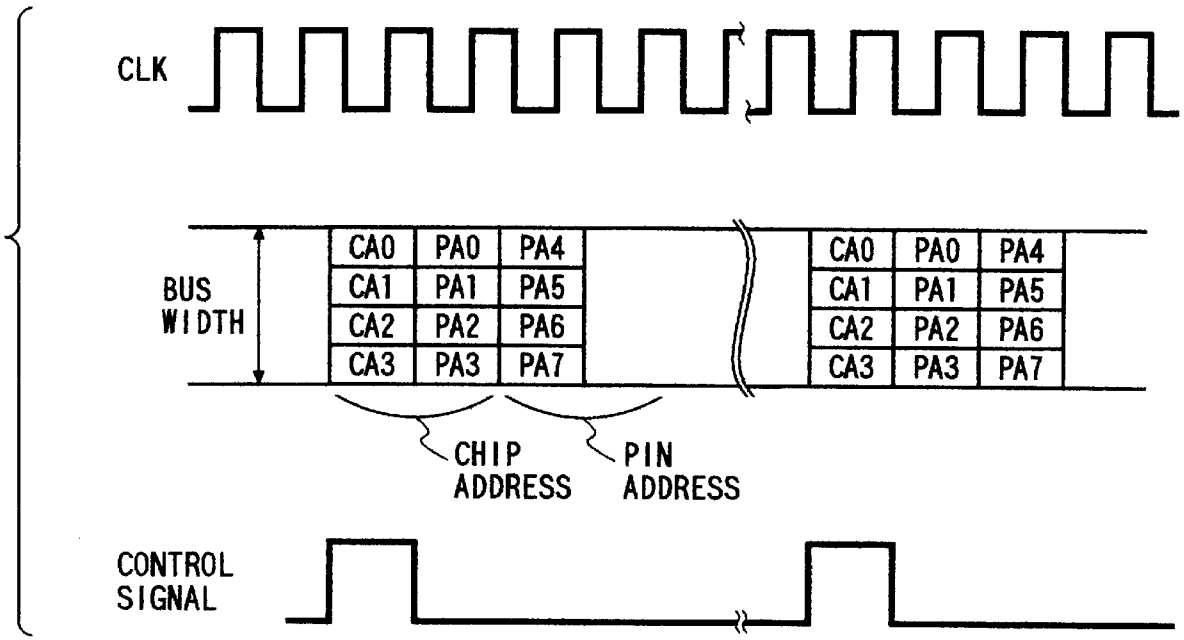
FIG. 18 is a timing chart showing the data transfer method according to the first embodiment of the present invention.

FIG. 18 is a timing chart for explaining in detail information to be received by the common drivers 102 in the circuit shown in FIGS. 15 and 16, and showing the data format on the 4-bit data bus 101 and the timings of the control signal.

The operation of each driver 102 will be explained below with reference to FIGS. 15 to 18. When the control signal is "1", each driver 102 compares data on the bus 1 with its own address, which is designated in advance in a hardware manner. When the two addresses match, the driver 102 recognizes that the data following the control signal is addressed to itself. For example, the driver 12-1 shown in FIG. 16 is assigned a fixed chip address "0, 0, 1, 0". When the control signal is "H" and information (CA0 to CA3) on the bus indicates "0, 0, 1, 0", the driver 12-1 recognizes that the information after this information indicates its own pin address, and begins to read the pin address (PA0 to PA7). As described above, according to this embodiment, using the 4-bit bus and a single control signal line, information for a maximum of 4,096 (=16×256) scanning lines can be transferred. With the data transfer method of this embodiment, even when the number of scanning lines increases, data can be transferred without increasing the number of signal lines, and this method is particularly effective for a large-screen, high-resolution display in future.

Since the address on the common driver side need only be designated within one horizontal scanning period, even when, e.g., 2,048 scanning lines are scanned at a speed of 60 Hz, the speed of the clock signal CLK at that time can be as low as about several hundreds of Hz, and data can be transferred at a relatively low transfer speed despite the small number of signal lines.

Figure 19:
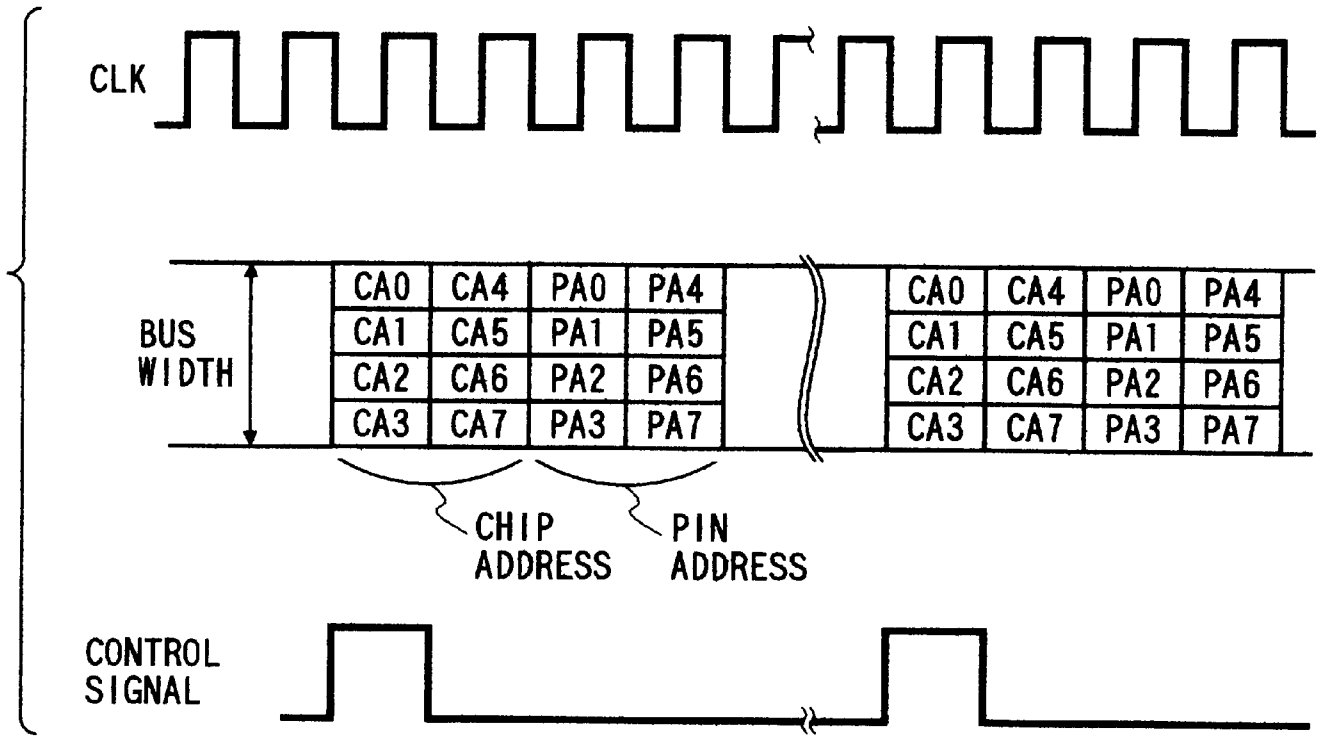
FIG. 19 is a timing chart showing a data transfer method according to the second embodiment of the present invention.

FIG. 19 is a timing chart showing the data transfer method according to a fourth embodiment of the present invention. In this embodiment, the chip address is serially transferred for two clocks using a 4-bit bus. With this arrangement, the number of drivers can be increased more easily. For example, in this embodiment, the number of drivers can be increased up to 256 without increasing the number of signal lines. More specifically, this embodiment can cope with a large-screen, high-resolution display having a maximum of 65,536 (=256×256) scanning lines.

Figure 20:
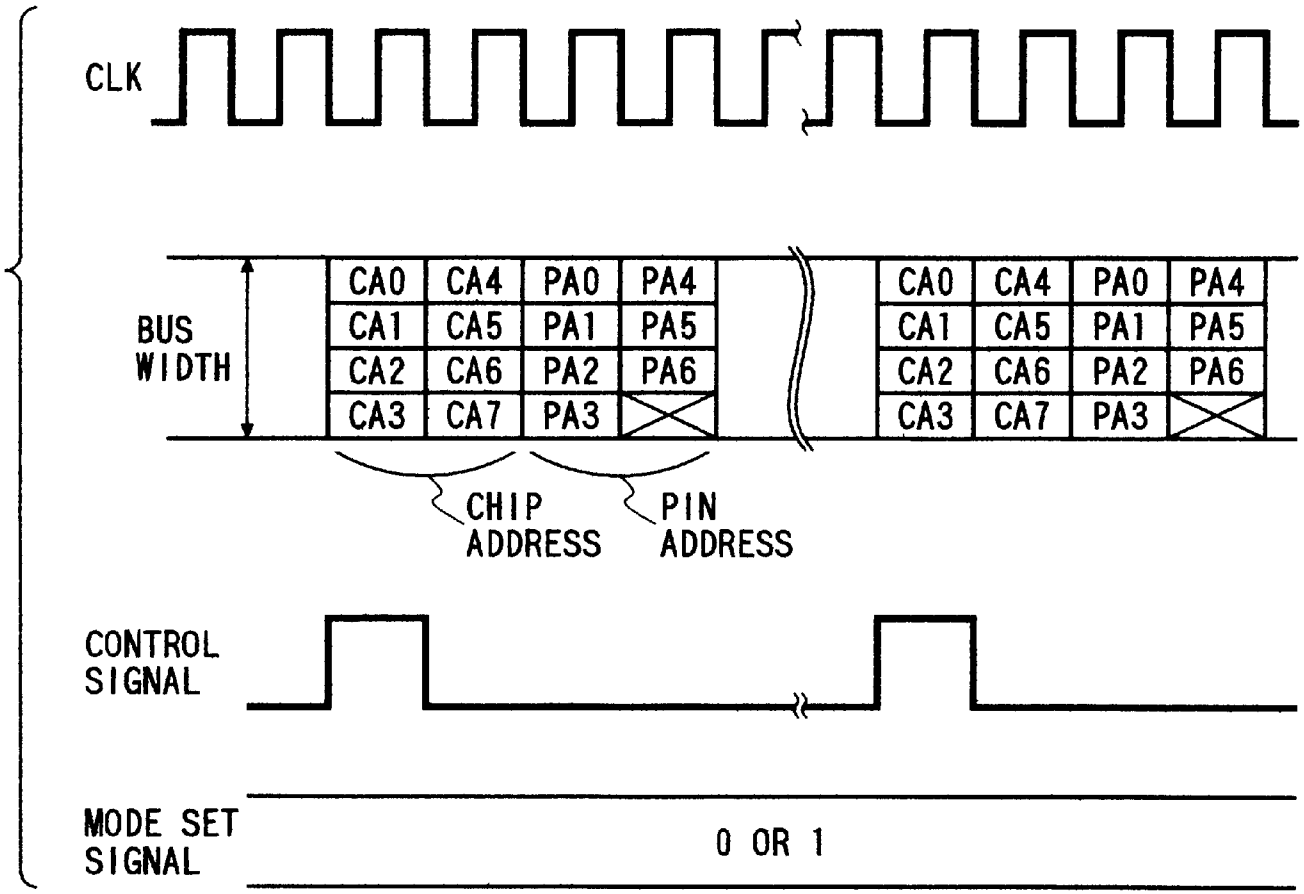
FIG. 20 is a timing chart showing a data transfer method according to the third embodiment of the present invention.
Figures 21, 22:
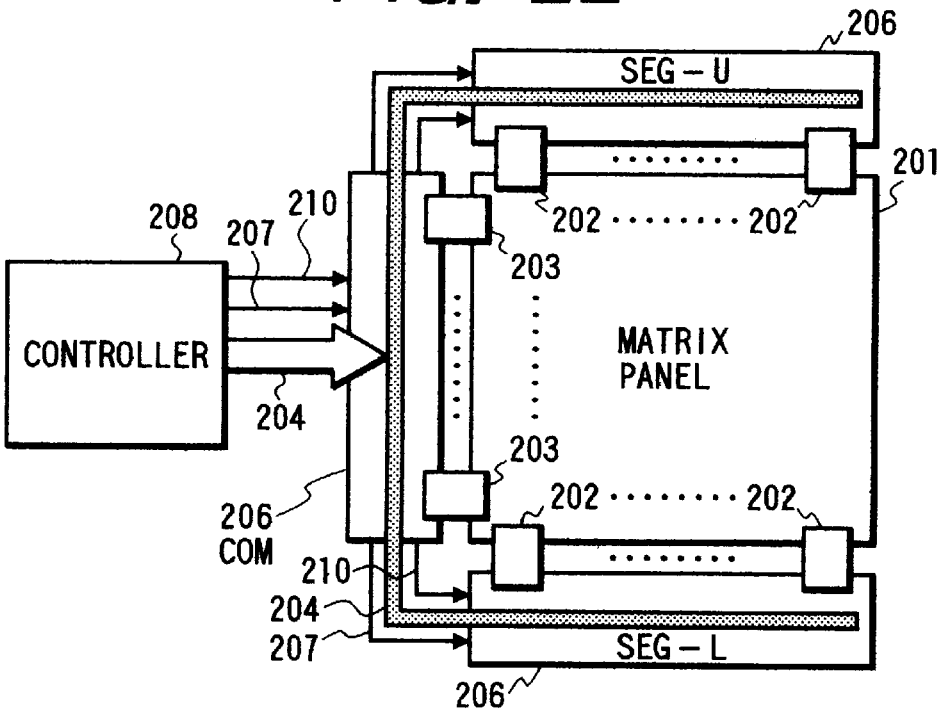
FIG. 21 is a table showing the addressing method in the data transfer method according to the third embodiment of the present invention.
FIG. 22 is a physical schematic diagram showing a data transfer method according to the first embodiment of the present invention.

FIG. 20 is a timing chart showing the data transfer method according to a fifth embodiment of the present invention. FIG. 21 is a table showing the method of addressing output pins in accordance with a mode signal in the fifth embodiment. This method is used when data is displayed on a display having, e.g., 2,048 physical scanning lines in a graphic mode with a resolution (e.g., 480 lines) lower than that of the display. When the mode set signal is "0", the driver 102 shown in FIG. 15 selects output pins one by one in accordance with the table shown in FIG. 21. When the mode set signal is "1", the controller 105 transmits a chip address while ignoring the least significant bit PA7 of the pin address signal, and the driver simultaneously selects output pins in units of two pins in accordance with the table shown in FIG. 21. Of course, this method can be applied to 4- or 8-pin simultaneous selection.

As described above, since the format of data output from the controller is realized by the data transfer method with control data, the number of signal lines between the controller and the driving integrated circuits can be reduced.

The present invention can easily cope with a case wherein the number of scanning lines is large, i.e., the number of driving integrated circuits (especially, common-side ICs) is large, and is particularly effective for a high-resolution display.

Figure 23:
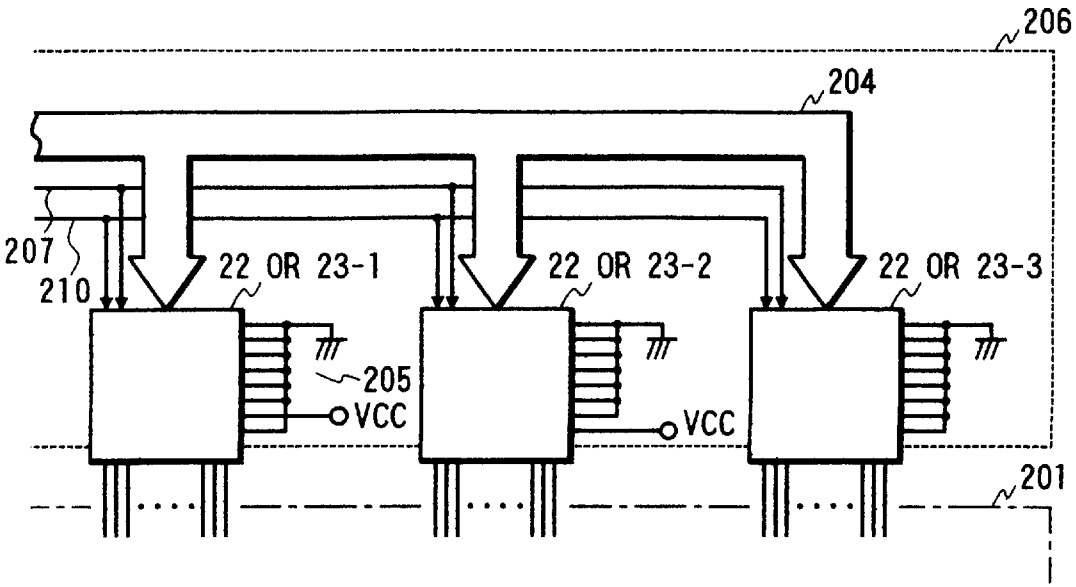
FIG. 23 is a schematic diagram showing the method of assigning chip addresses in a hardware manner in the first embodiment of the present invention.
Figure 24:
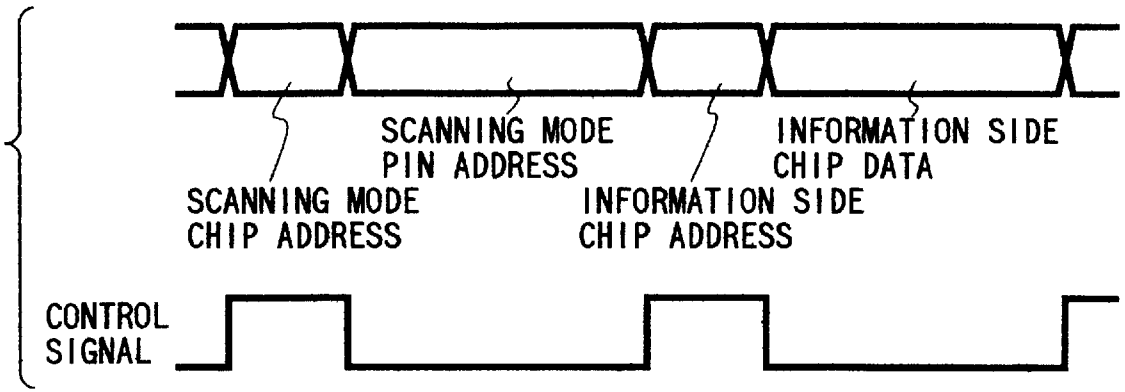
FIG. 24 is a schematic chart showing the data transfer method according to the first embodiment of the present invention.

FIG. 22 is a physical schematic diagram showing the data transfer method for a display apparatus driving circuit according to a sixth embodiment of the present invention. FIG. 23 is a schematic diagram showing the method of fixing the chip addresses of segment and common drivers in the circuit shown in FIG. 22 in a hardware manner. Referring to FIGS. 22 and 23, the circuit comprises a display apparatus (FPD) 201, segment drivers 202, common drivers 203, a common bus 204, chip address terminals 205, bus boards 206, a control signal line 207, a controller 208, and a clock signal (CLK) line 210. FIG. 24 is a schematic chart showing the data transfer method of transferring data to the segment drivers 202 in the circuit shown in FIG. 22.

In this embodiment, as shown in FIG. 22, the controller 208 and the drivers 202 and 203 for driving the display apparatus 201 are connected via the common bus 204, and a chip address signal, a pin address signal, video data, and a data discrimination signal are time-divisionally transferred in the data format shown in FIG. 24. Designation of the output pins of the common drivers 203 and transfer of video information corresponding to all the segment drivers 202 (or the drivers corresponding to a change point) are completed within one horizontal scanning period, thus driving the display apparatus 201.

Figure 25:
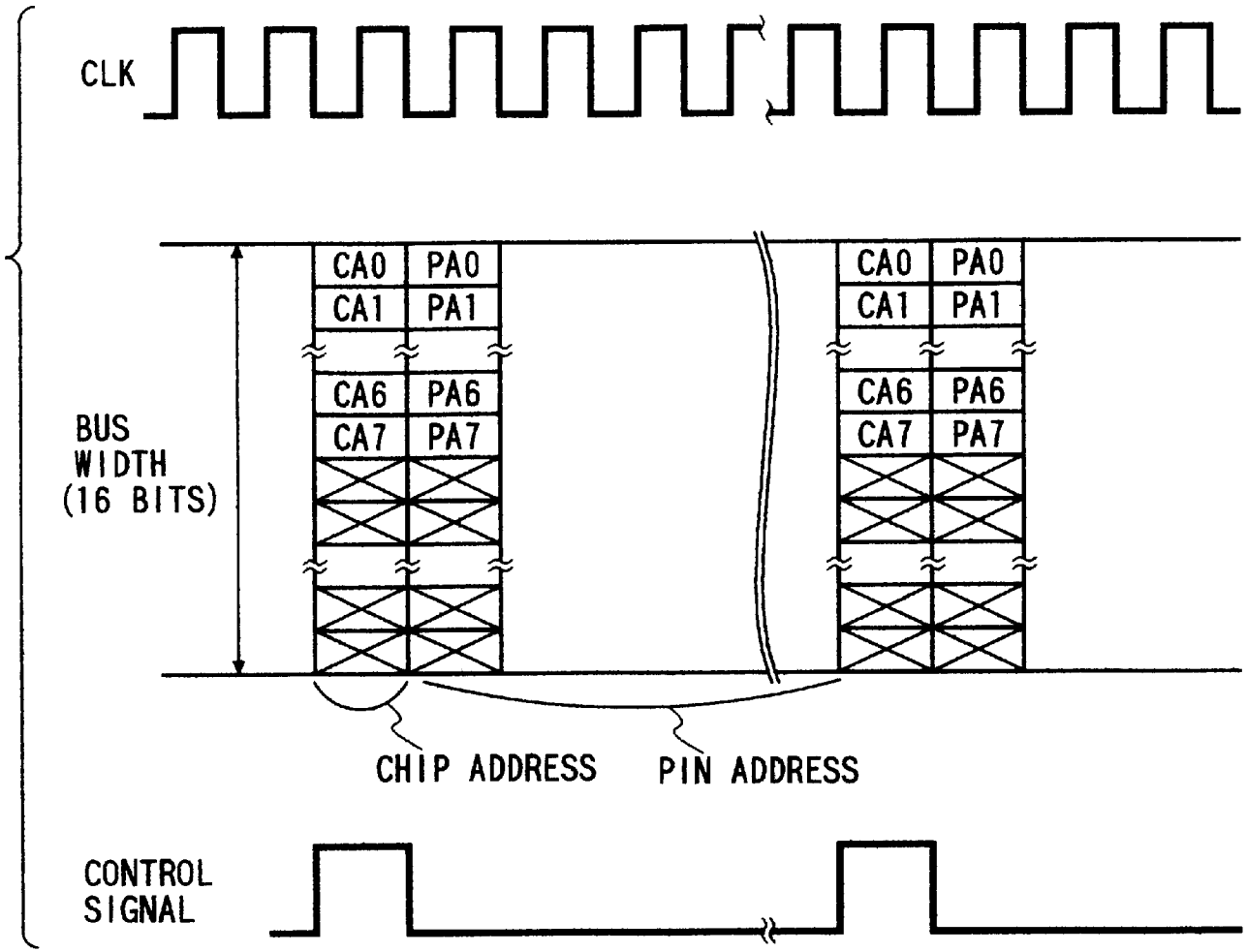
FIG. 25 is a timing chart showing the data transfer method for common drivers according to the first embodiment of the present invention.

FIG. 25 is a timing chart for explaining in detail the information to be received by the common drivers 203 (203-1, 203-2, 203-3, . . . ) in the circuit shown in FIGS. 22 and 23, i.e., showing the data format on the 16-bit bus 204-and the timings of the control signal.

The operation of each common driver 203 will be described below with reference to FIGS. 22 to 25. Note that the output pin address of each common driver 203 to be described below must be designated for the purpose of various kinds of interlaced scanning operations. When the control signal is "1", each common driver 203 recognizes that the data on the bus 204 is chip address information. Each common driver 203 is assigned a unique chip address by fixing a plurality of pins of its chip address terminal 205 to ground (GND: corresponding to, e.g., "0") or VCC (the upper reference potential: corresponding to, e.g., "1") on the printed board 206, as shown in FIG. 23. When the chip address data on the bus 204 agrees with its own chip address, the common driver 203 recognizes that the following data is its own pin address information, and fetches the information. According to the data transfer method of this embodiment, which transfers each pin address information, as described above, even when the number of scanning lines increases, data can be transferred without increasing the number of signal lines, and this method is particularly effective for a large-screen, high-resolution display in future.

Figure 26:
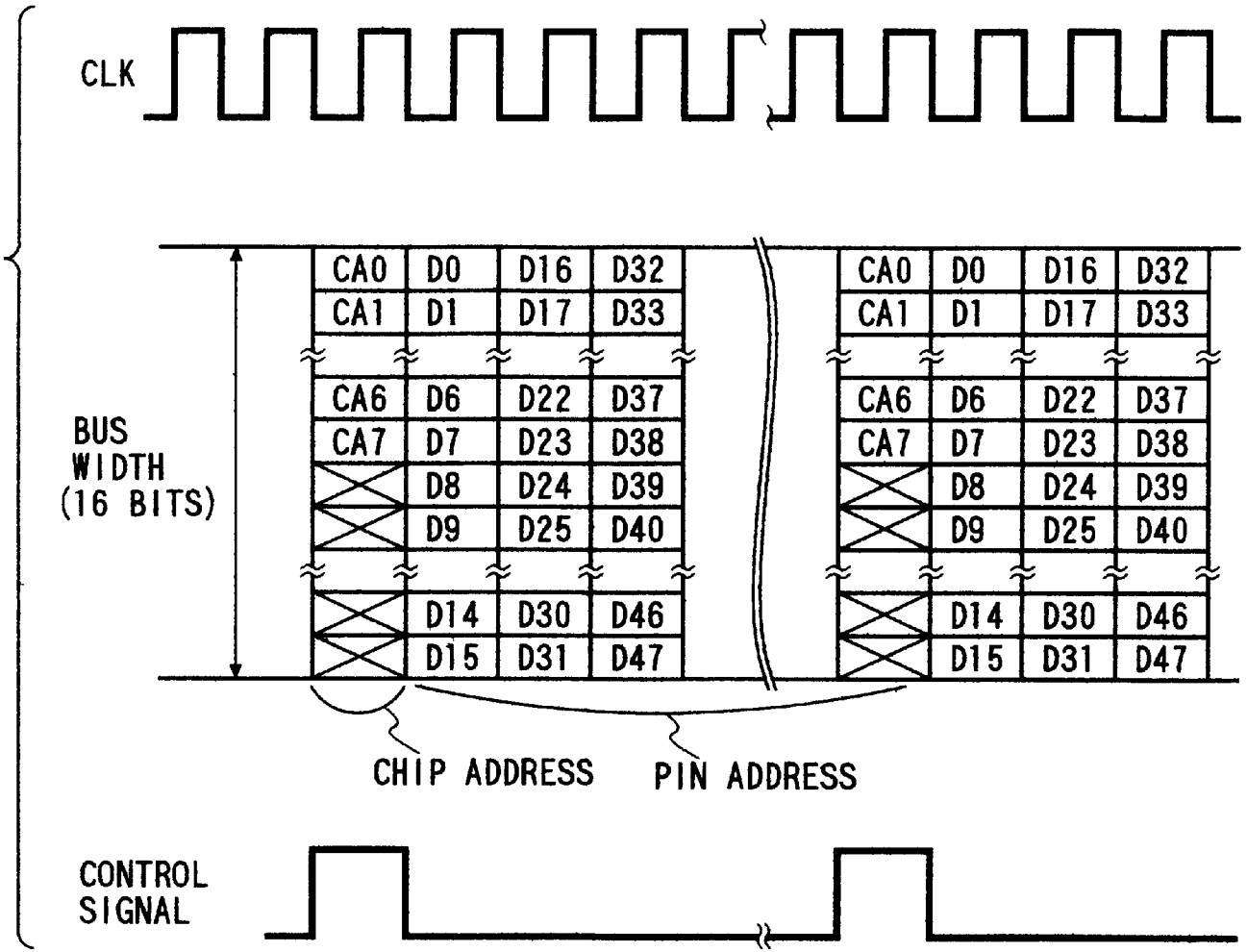
FIG. 26 is a timing chart showing the data transfer method for segment drivers according to the first embodiment of the present invention.
Figure 27:
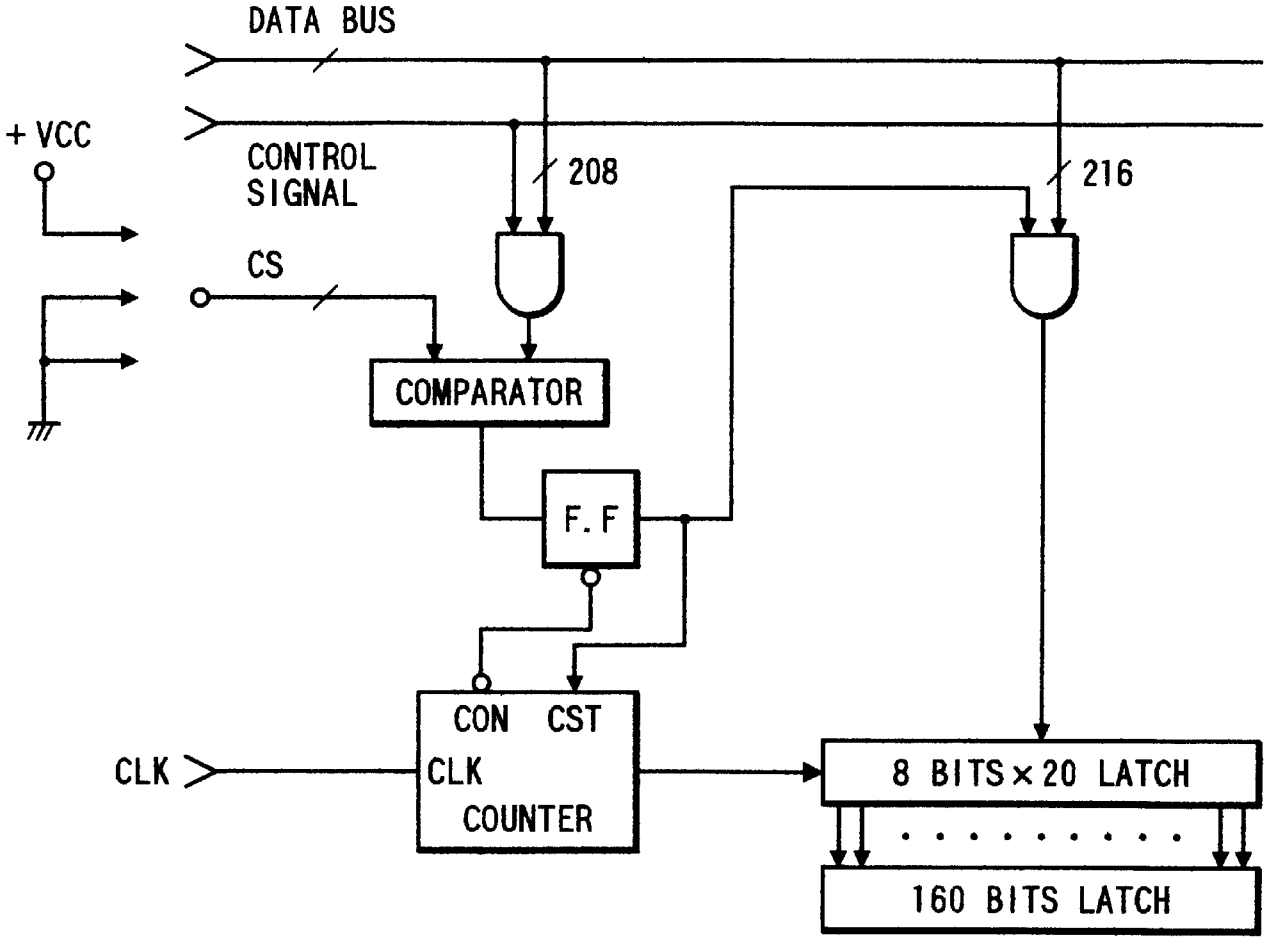
FIG. 27 is a circuit diagram showing the arrangement of the segment driver according to the first embodiment of the present invention.

FIG. 26 is a timing chart for explaining in detail the information to be received by the segment drivers 202 (22-1, 22-2, 22-3, . . . ) in the circuit shown in FIGS. 22 and 23, i.e., showing the data format on the 16-bit data bus 204 and the timings of the control signal. FIG. 27 is a block diagram showing the arrangement of the segment driver in the circuit shown in FIG. 22.

The operation of each segment driver 202 will be described below with reference to FIGS. 22 to 24 and FIGS. 26 and 27. When the control signal is "1", each segment driver 202 recognizes that the data on the bus 204 is chip address information. Each segment driver 202 is assigned a unique chip address by fixing a plurality of pins of its chip address terminal 205 to ground (GND: corresponding to, e.g., "0") or VCC (the upper reference potential: corresponding to, e.g., "1") on the printed board 206, as shown in FIG. 23. When the chip address data on the bus 204 is equal to its own chip address, the segment driver 202 recognizes that the following data is video data information addressed thereto. When data for 10 clocks are transferred on the 16-bit bus, transfer of video data for 160 bits is completed. Each segment driver 202 holds previous data until it receives new data, and drives the display apparatus in accordance with the held data. Therefore, according to the data transfer method of this embodiment, the controller detects a change in video data, and transfers data of only the changed portion (in units of drivers) to reduce the average data transfer amount, thus contributing to reductions of consumption power and radiation noise.

Figure 28:
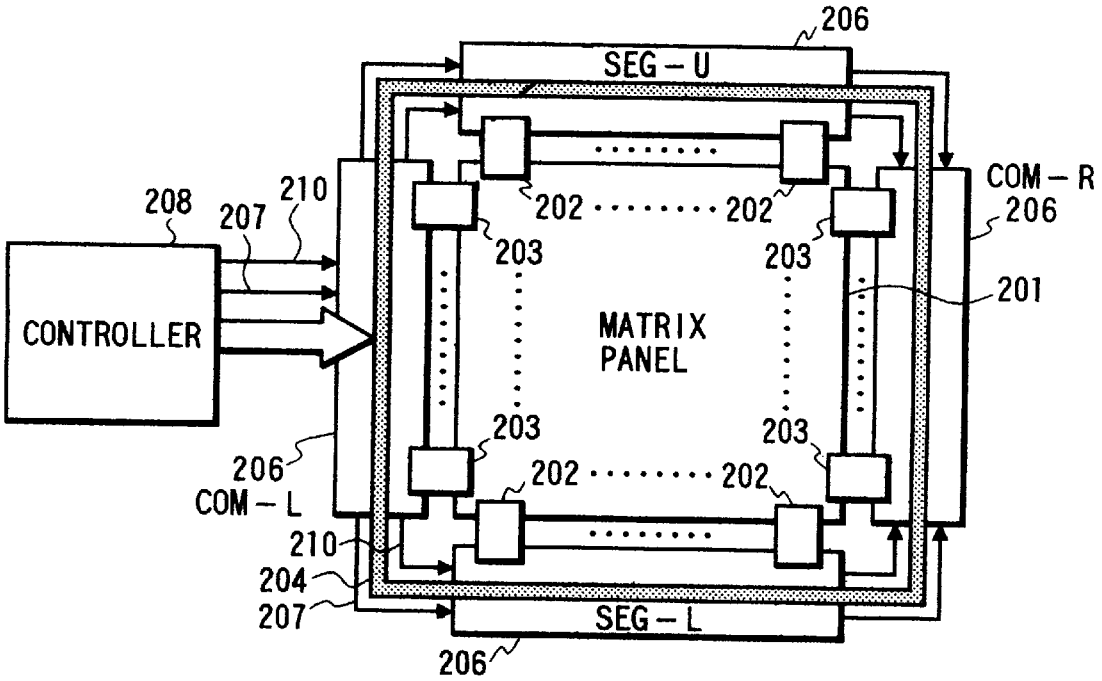
FIG. 28 is a physical schematic diagram showing a data transfer method according to the second embodiment of the present invention.

FIG. 28 is a physical schematic diagram showing the data transfer method according to a seventh embodiment of the present invention. That is, in the driving circuit of the seventh embodiment, the common drivers 203 are arranged on the right and left sides of the display apparatus 201, the segment drivers 202 are arranged on the upper and lower sides of the display apparatus 201, and these drivers are connected via the common bus line 204 to surround the four sides of the display apparatus 201. According to the second embodiment, even when the number of scanning lines is as large as the bus boards (printed boards) 206 required on the four sides of the display apparatus 201, a space-saving wiring layout can be realized without increasing the number of signal lines from the controller 208. Since the bus boards 206 are arranged on the four sides of the display apparatus 201 in a ring pattern, and the drivers 202 and 203 and the controller 208 are connected via the common bus line 204, connection points to the controller 208 can be set at arbitrary positions on the bus line 4, thus allowing easy connection with an external device.

As described above, according to the present invention, since the common bus includes both segment and common signal lines and data output from the controller have a common data format to realize a data transfer method with control data, the number of signal lines between the controller and driving integrated circuits can be reduced.

By transferring only changed data to the driving integrated circuits (especially, segment-side ICs), the average data transfer amount can be reduced.

Furthermore, the present invention can easily cope with a case wherein the number of driving integrated circuits (especially, common-side ICs) is large, and is particularly effective for a high-resolution display.

Moreover, since the bus line has a ring-shaped layout, connection points to the controller can be set at arbitrary positions on the bus line, thus allowing easy connection with an external device.

Figure 29:
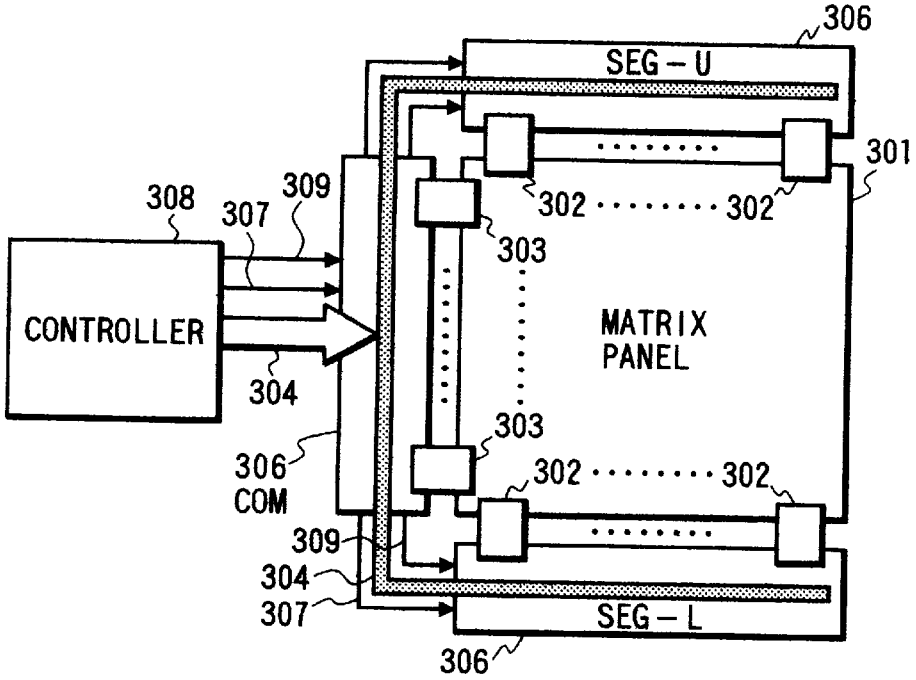
FIG. 29 is a physical schematic diagram showing a display apparatus driving circuit that adopts the data transfer method according to the first embodiment of the present invention.
Figure 30:
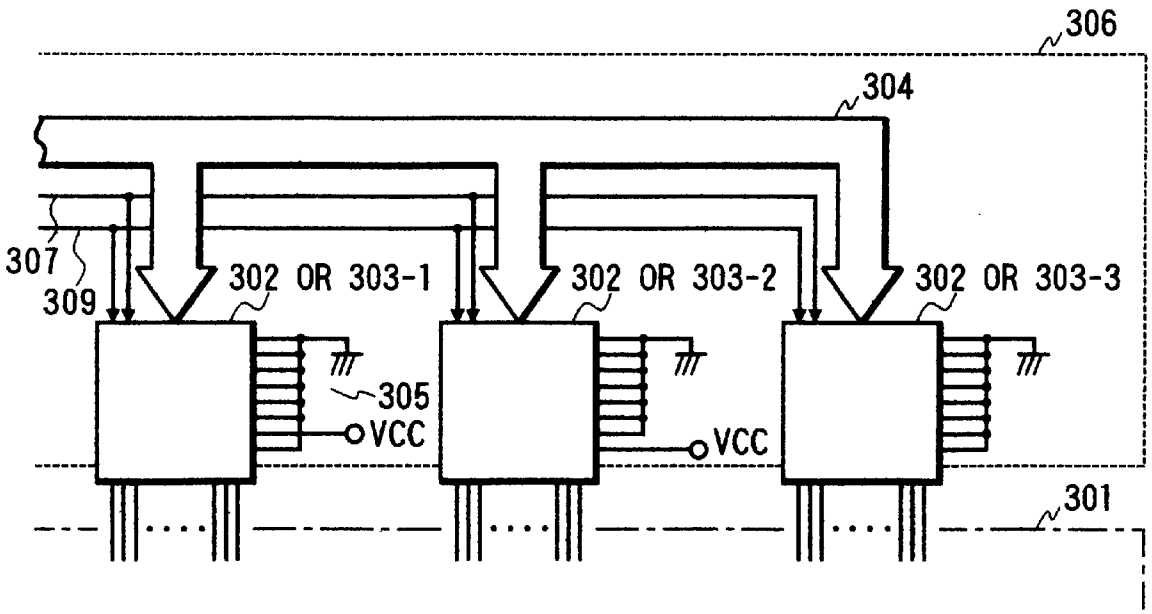
FIG. 30 is a schematic diagram showing the method of fixing chip addresses of drivers in a hardware manner in the circuit shown in FIG. 29.

FIG. 29 is a physical schematic diagram showing a display apparatus driving circuit according to an eighth embodiment of the present invention, and FIG. 30 is a schematic diagram showing the method of fixing the chip addresses of information- and scanning-side drivers 302 and 303 in the circuit shown in FIG. 29 in a hardware manner. Referring to FIGS. 29 and 30, the circuit comprises a display apparatus (panel) 301, information-side (segment) drivers 302, scanning-side (common) drivers 303, a common bus 304, chip select terminals 305, bus boards (printed boards) 306, a clock signal line 307, a controller 308, and a control signal line 309.

Figure 31:
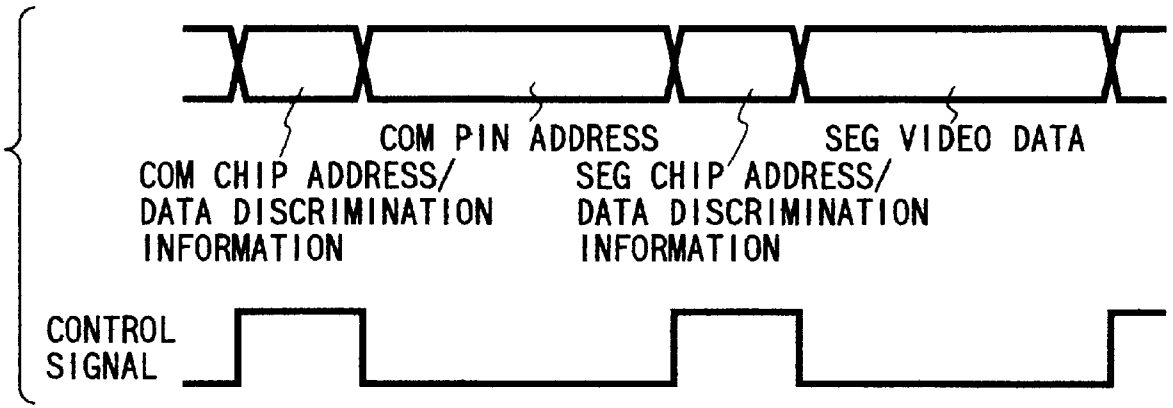
FIG. 31 is a schematic chart showing the data transfer method in the circuit shown in FIG. 29.
Figure 32:
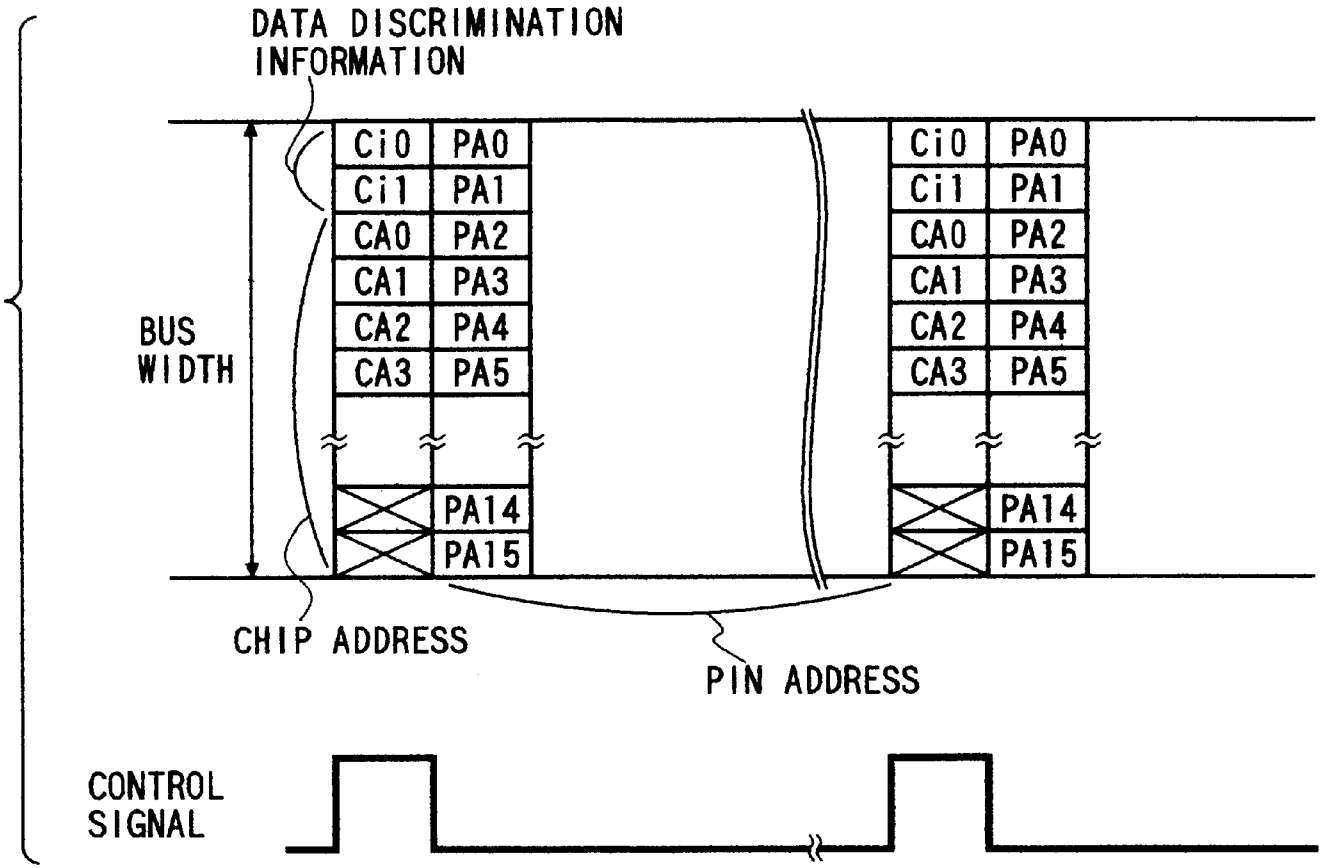
FIG. 32 is a view showing the data format for a scanning-side driver in the circuit shown in FIG. 29.
Figure 33:
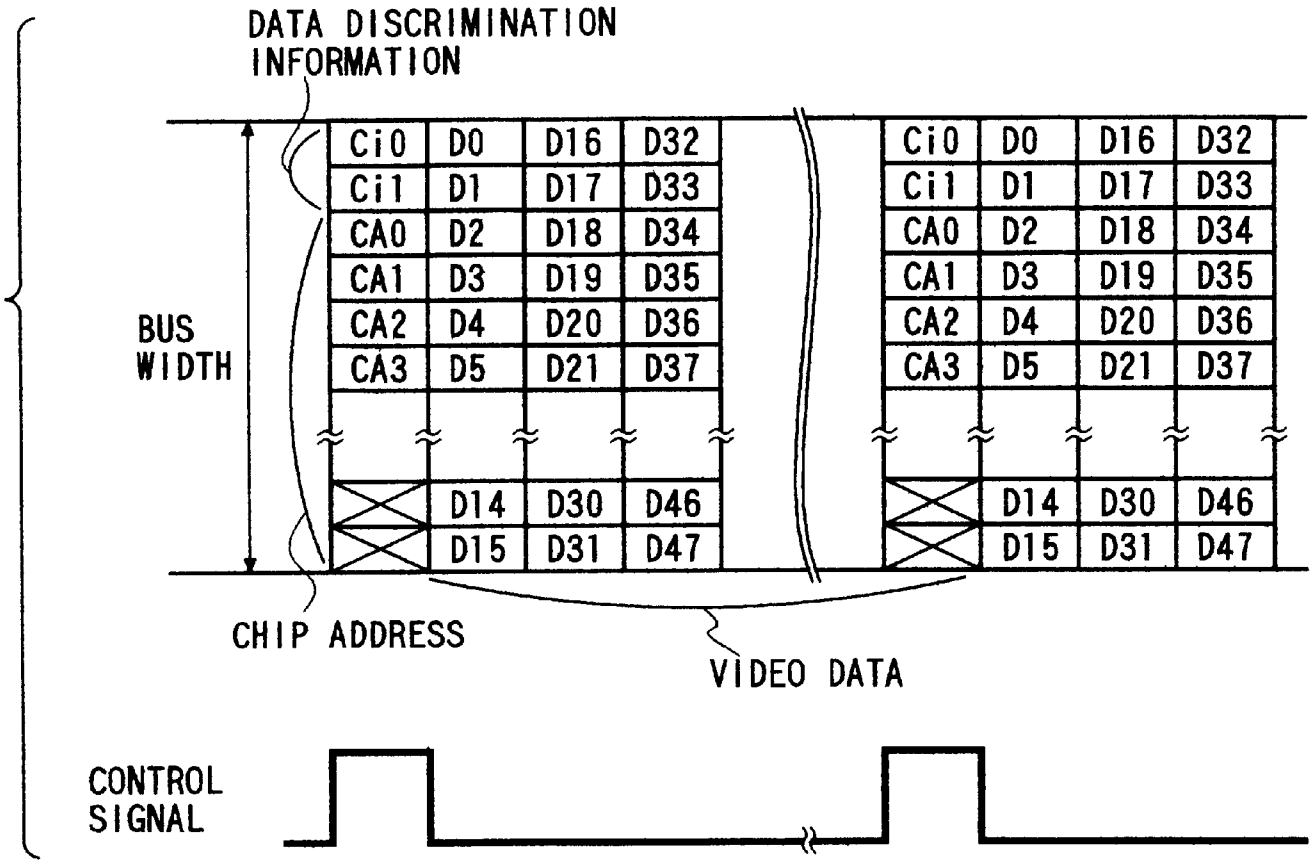
FIG. 33 is a view showing the data format for an information-side driver in the circuit shown in FIG. 29.
Figure 35:
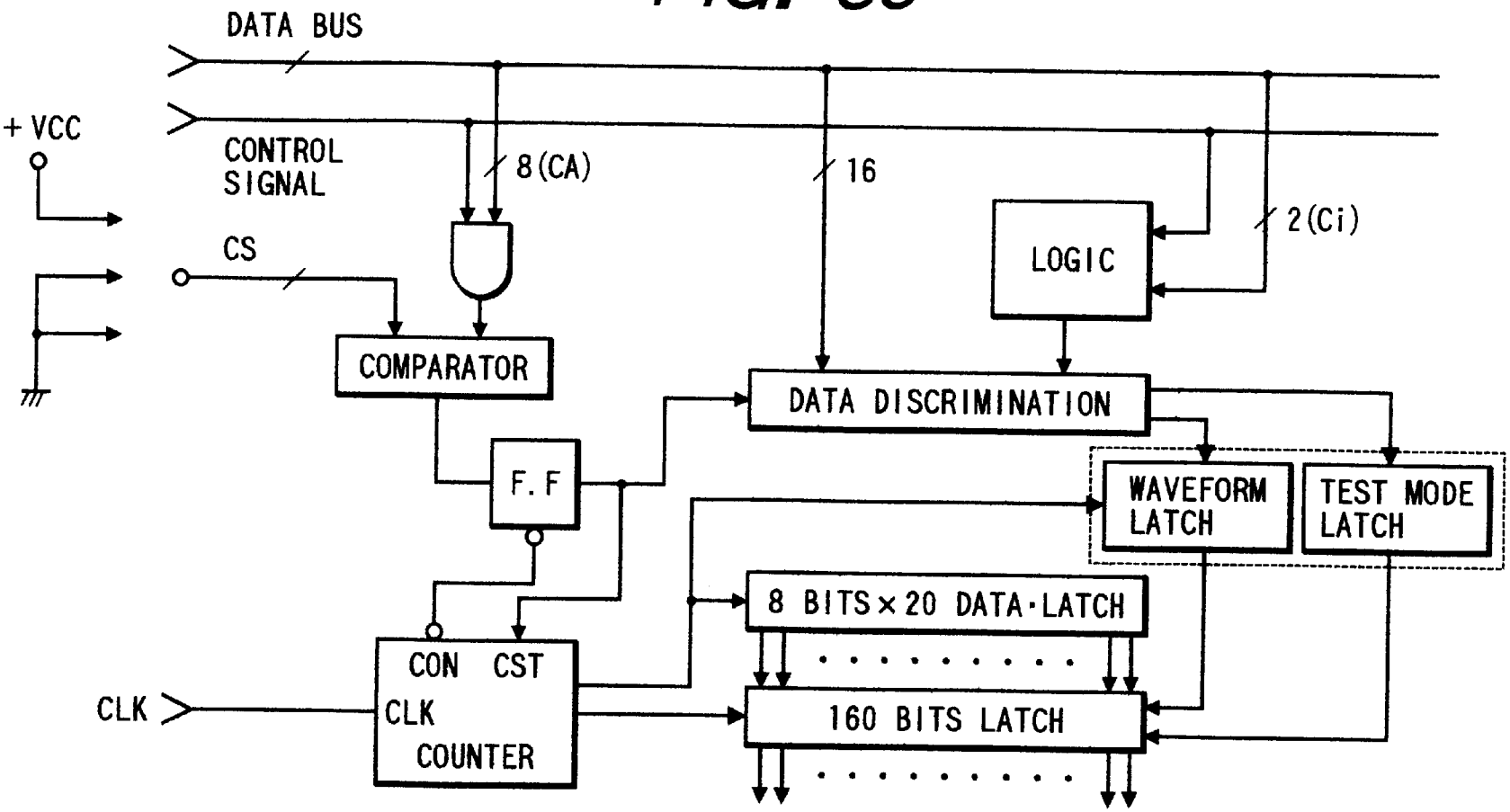
FIG. 35 is a block diagram showing the arrangement of an information-side driver in the circuit shown in FIG. 29.

FIG. 31 is a schematic chart showing the data transfer method in the circuit shown in FIG. 29. FIG. 32 shows the data format of the scanning-side drivers 303 in the circuit shown in FIG. 29. FIG. 33 shows the data format of the information-side drivers 302 in the circuit shown in FIG. 29. FIG. 34 shows the format of a data discrimination signal in the circuit shown in FIG. 29. FIG. 35 is a block diagram showing the arrangement of the information-side driver 302 in the circuit shown in FIG. 29.

As shown in FIG. 29, the drivers 302 and 303 for driving the display apparatus 301 are connected via the common bus 304, and chip address information, pin address information, video data information, a data discrimination signal, waveform information, mode set information, and test mode information are time-divisionally transferred on the bus 304 in the data format shown in FIGS. 31 and 32.

When the control signal is "1", each scanning-side driver 303 recognizes that the data on the bus 304 are chip address information and a data discrimination signal. Each scanning-side driver 303 is assigned a unique chip address by fixing a plurality of pins of its chip address terminal 305 to ground (GND) or VCC (upper reference potential) on the printed circuit board 306, as shown in FIG. 30. When the chip address data on the bus 304 agrees with its own chip address, the scanning-side driver 303 recognizes that the following information is that addressed to itself. The driver 303 discriminates in accordance with the combination of data discrimination signals sent simultaneously with the chip address data, i.e., the table shown in FIG. 34, if the following information is pin address information, scanning mode information, or waveform information, and fetches the discriminated information. At this time, if the received data is pin address information, the scanning-side driver 303 applies, from output pins designated by the pin address information, a voltage according to scanning mode information and waveform information, i.e., the correspondence tables shown in FIG. 37, to the display apparatus 301. In this case, the driver 303 holds previous scanning mode information and waveform information until it receives new information, and outputs data in accordance with the held information.

When the control signal is "1", each information-side driver 302 recognizes that the data on the bus are chip address information and a data discrimination signal. Each information-side driver 302 is assigned a unique chip address by fixing a plurality of pins of its chip address terminal 305 to ground (GND) or VCC (upper reference potential) on the printed circuit board 306, as shown in FIG. 30. When the chip address data on the bus 304 is equal to its own chip address, the information-side driver 302 recognizes that the following information is that addressed to itself. Also, the driver 302 discriminates in accordance with the combination of data discrimination signals sent simultaneously with the chip address data, i.e., the table shown in FIG. 34, if the following information is video data information, waveform information, or test mode information. If the received data is video data information, the information-side driver 302 receives video data corresponding to its own output pins, and thereafter, applies a voltage according to waveform information and test mode information, i.e., a voltage according to the correspondence table shown in FIG. 38, to the display apparatus 301 in synchronism with an output waveform control clock signal. At this time, the driver 302 holds previous waveform information until it receives new information, and outputs data in accordance with the held information.

By performing the above-mentioned data transfer for all the information- and scanning-side drivers 302 and 303 within one horizontal scanning period, data transfer within one horizontal scanning period is completed. On the other hand, a mode set signal and a waveform information signal are transferred using a rest period in which no scanning is performed. For example, in a display apparatus having 1,024 scanning lines, even when the mode set signal and the waveform information signal are updated once during the refresh period of one frame, only an interrupt period 1/1024 the horizontal-scanning period is required, and has no influence on display quality.

As described above, according to the data transfer method of the present invention, data to be output from the controller to the scanning-side/information-side drivers have a common data format, and chip address information, pin address information, waveform information, and mode set information for the scanning-side drivers, chip address information, video data information, waveform information, and test mode information for the information-side drivers, and control data for discriminating such information are time-divisionally transferred onto the common bus. Thus, the number of signal lines between the controller and drivers can be reduced, and the occupation ratio of cables and printed boards in a housing can be reduced, thus attaining a size reduction of the housing and a cost reduction. The decrease in the number of signal lines can contribute to a reduction of radiation noise. Furthermore, since waveform information and mode set information can be independently transferred in units of drivers, each driver can output an arbitrary waveform.

Figures 37, 38:
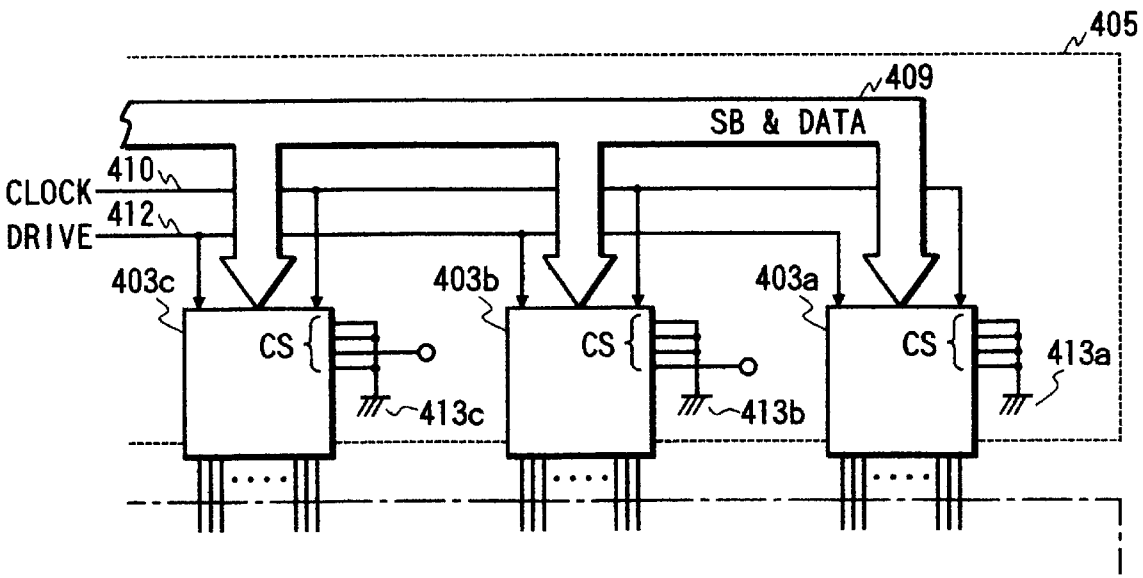
FIG. 37 is a correspondence table showing the relationship between the combination of test mode signals in an information-side driver and the output voltage in the conventional data transfer method.
FIG. 38 is a block diagram showing the arrangement of driving circuits according to the first embodiment of the present invention.
Figure 39:
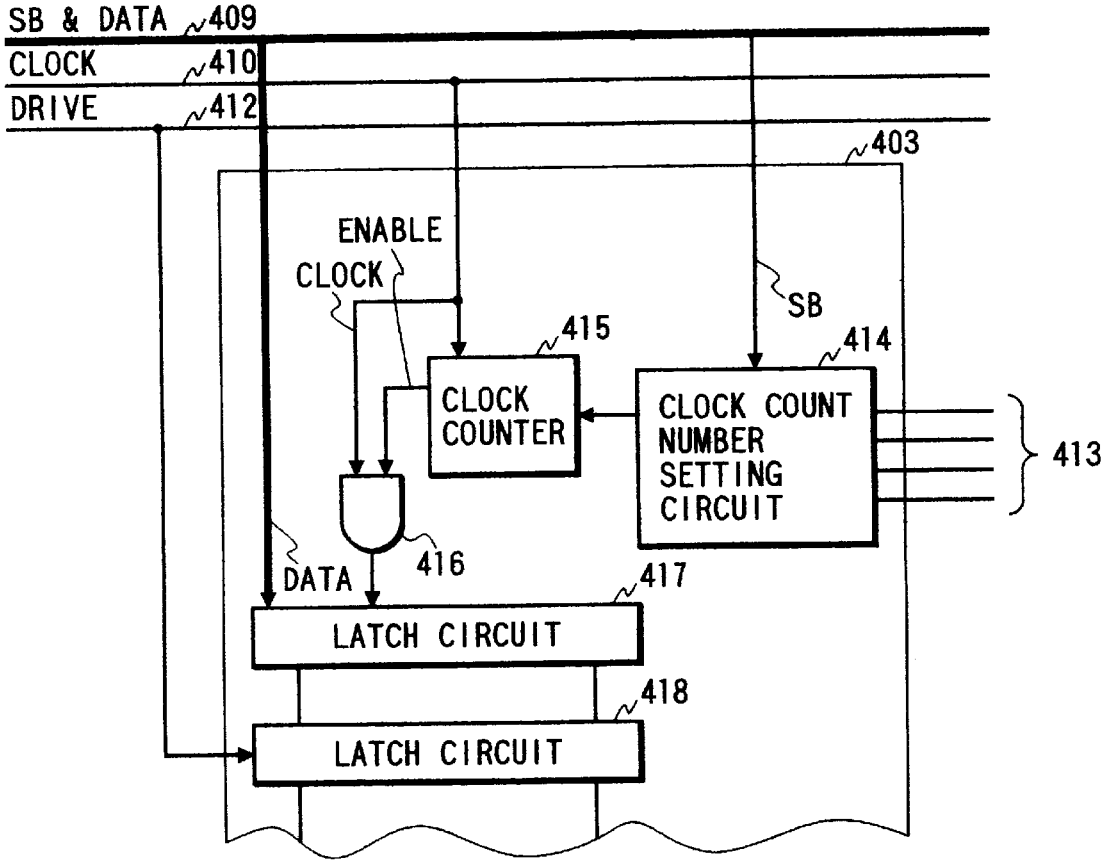
FIG. 39 is a block diagram showing in more detail the arrangement of the driving circuit shown in FIG. 38.

FIG. 38 shows the arrangement of a driving circuit according to a nineth embodiment of the present invention. The same reference numerals in FIG. 38 denote the same or corresponding parts as in the prior art shown in FIGS. 5 and 6, and a detailed description thereof will be omitted. Referring to FIG. 39, CS signals 413 (413*a*, 413*b*, 413*c*) are defined by hardware patterns on a bus board 405 and are used for recognizing the mounting positions of driving circuits 403 (403*a*, 403*b*, 403*c*) by themselves.

FIG. 39 shows the detailed arrangement of the driving circuit 403. Referring to FIG. 39, the driving circuit comprises a clock count number setting circuit 414 for calculating the clock count number until the beginning of fetching of image data of the driving circuit 403*a*, 403*b*, or 403*c* on the basis of the start bit (SB) signal transferred from a controller and the mounting position information obtained from the bus board, and setting the calculated clock count number in a counter, a clock counter 415 for counting the count number set by the clock count number setting circuit 414, and enabling a first latch circuit 417 (to be described later) so as to fetch data into the driving circuit upon completion of the count operation, an AND gate 416 for ANDing clocks and an enable signal output from the clock counter 415, and outputting the AND to the first latch circuit (to be described below), the first latch circuit 417 for sequentially fetching image data from the data bus in synchronism with the signal supplied from the AND gate 416 and supplying the fetched image data to the next latch circuit 418 upon completion of fetching, and a second latch circuit 418 for fetching data for one line into the driving circuit upon reception of image data from the first latch circuit 417, and thereafter, simultaneously outputting the image data.

Figures 40A, 40B, 40C, 40D, 40E:
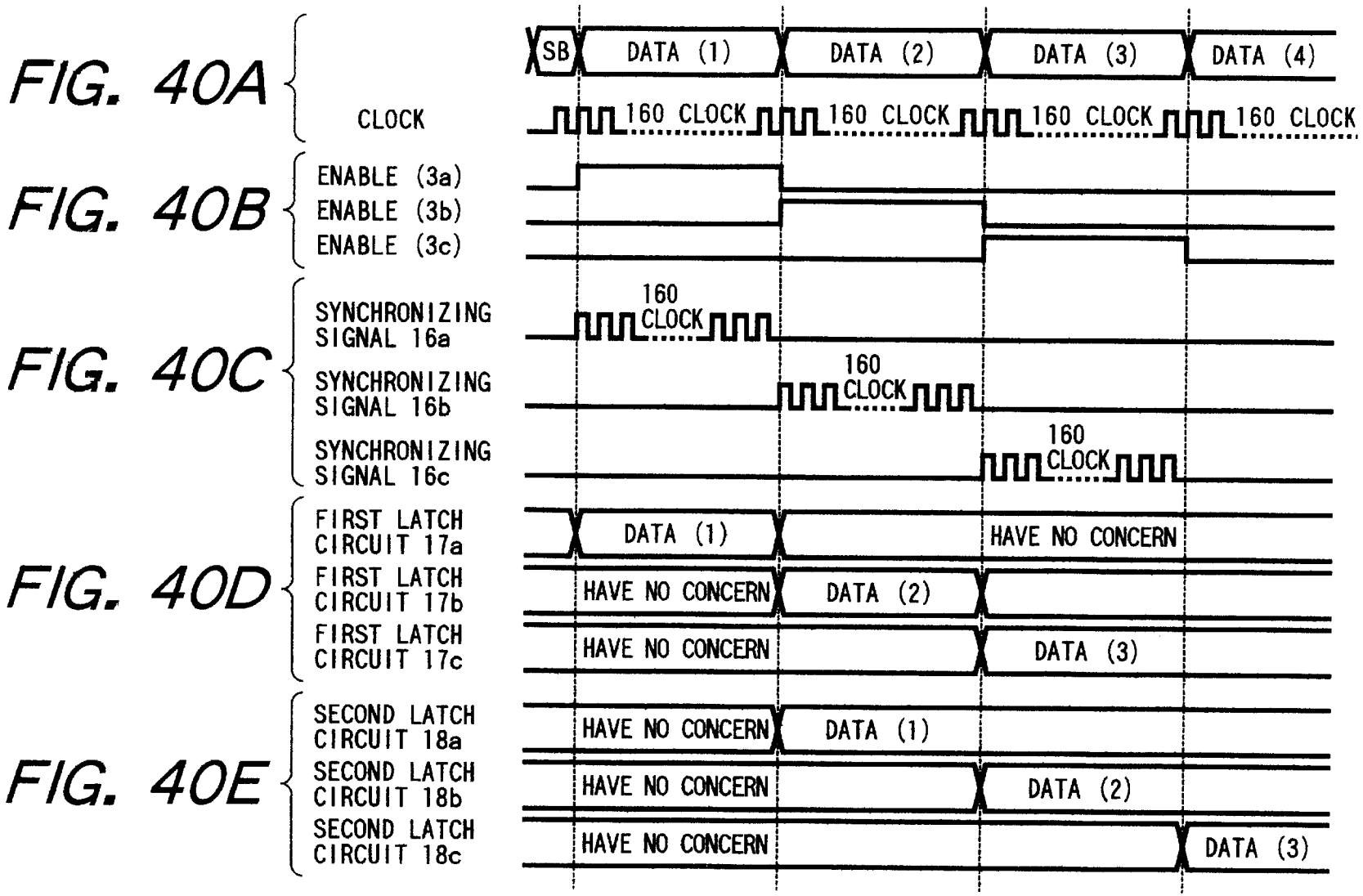
FIGS. 40A to 40E are timing charts showing the operations of the driving circuits shown in FIG. 38.

FIG. 40 is a timing chart of the driving circuit shown in FIG. 39. FIG. 40A shows image data supplied onto a data bus 409, FIG. 40B shows enable signals output from the clock counters 415*a* to 415*c* in the driving circuits 403*a* to 403*c*, FIG. 40C shows synchronizing signals which are output from the AND gates 416 and are used for fetching image data into the first latch circuits 417*a* to 417*c*, and FIGS. 40D and 40E show the image data fetching operations of the first and second latch circuits 417*a* to 417*c* and 418*a* to 418*c*.

Figure 1:
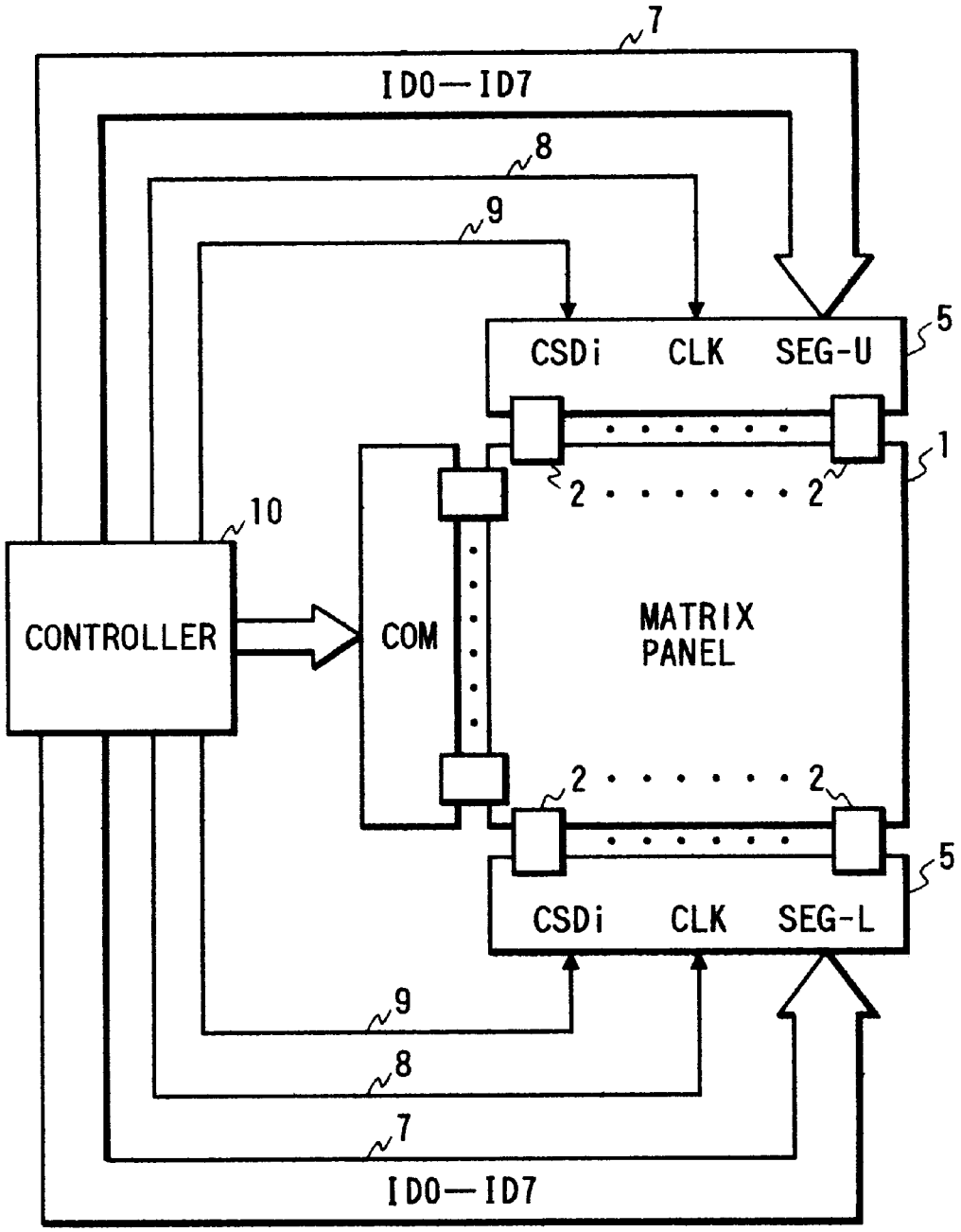
FIG. 1 is a physical schematic diagram showing a conventional data transfer method.
Figure 2:
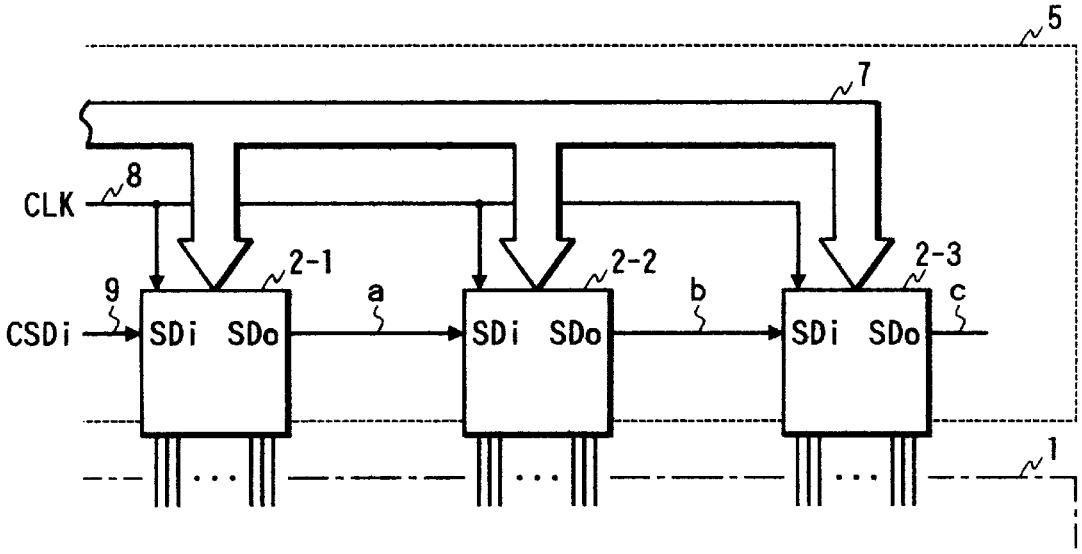
FIG. 2 is a schematic diagram showing the conventional data transfer method.
Figure 4:
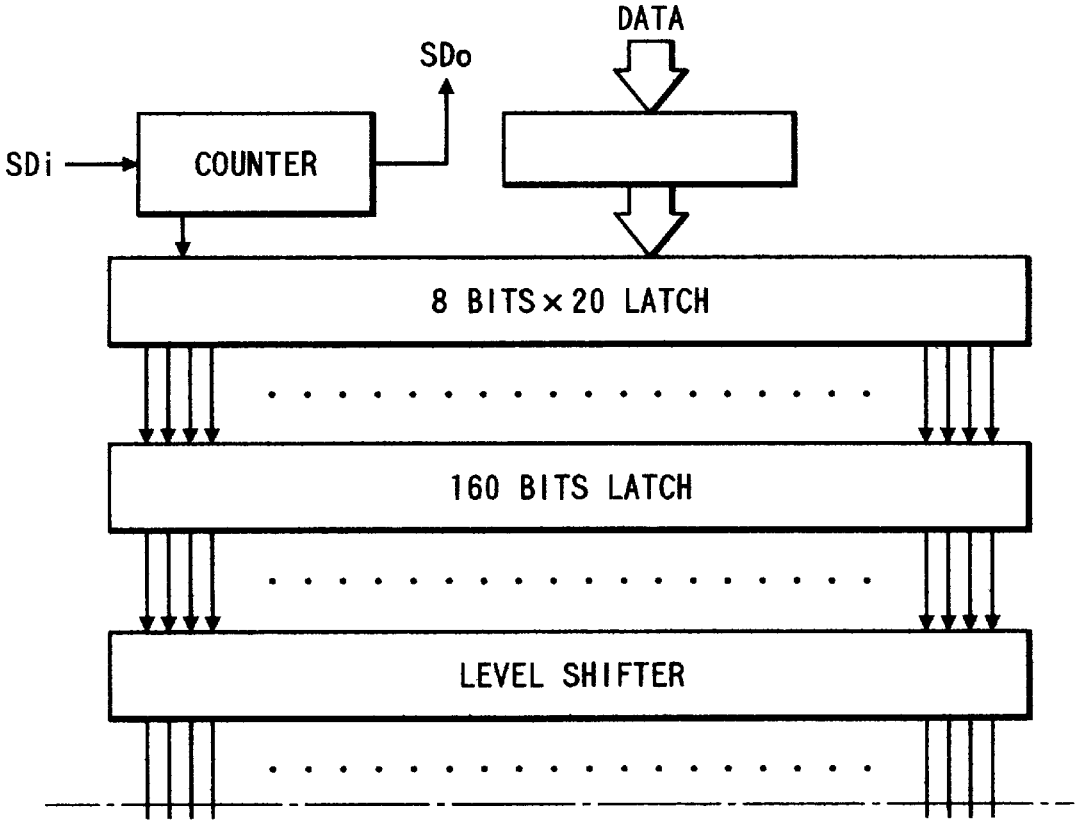
FIG. 4 is a diagram showing the arrangement of a segment driver in the conventional data transfer method.
Figure 3:
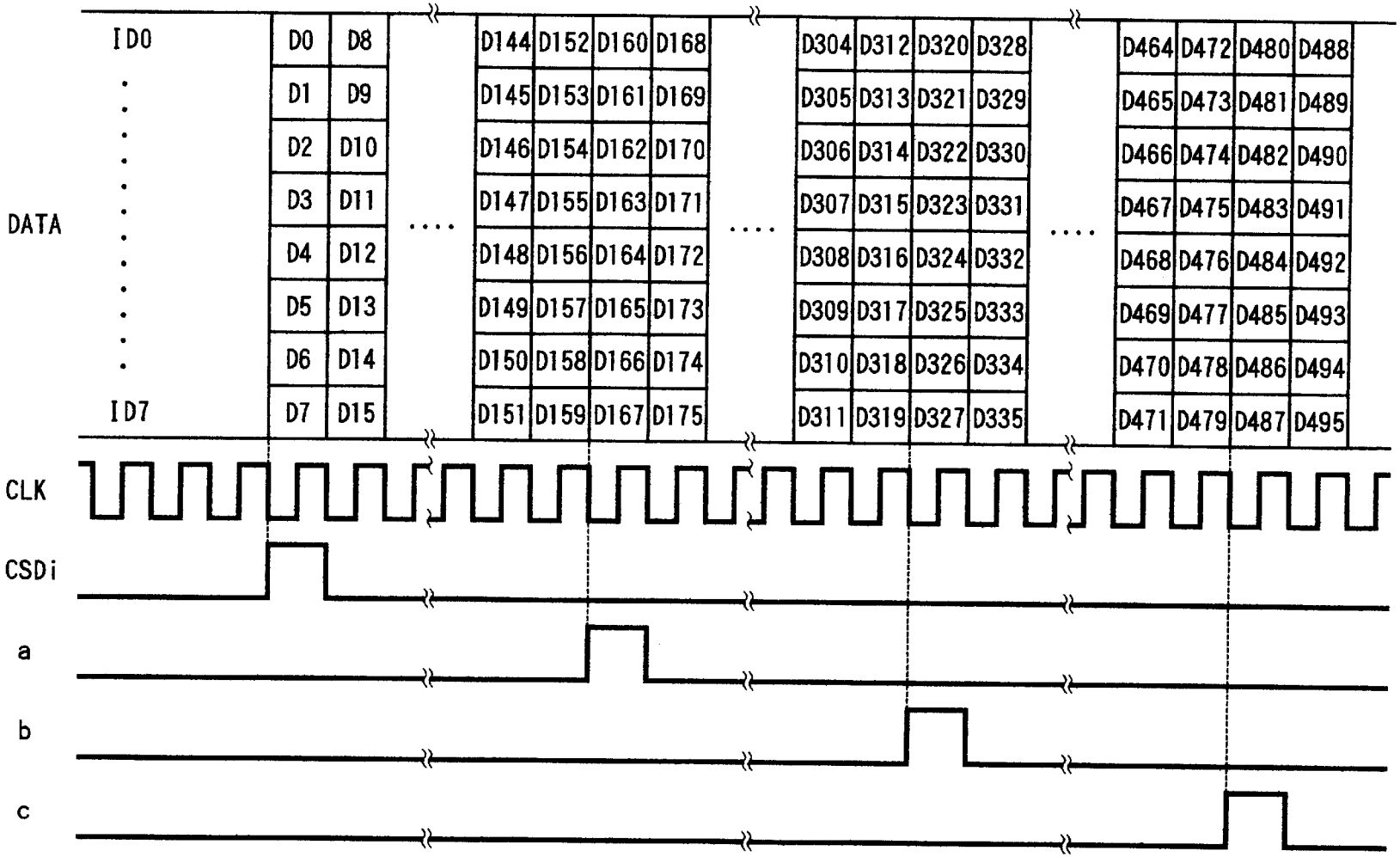
FIG. 3 is a timing chart showing the conventional data transfer method.
Figure 5:
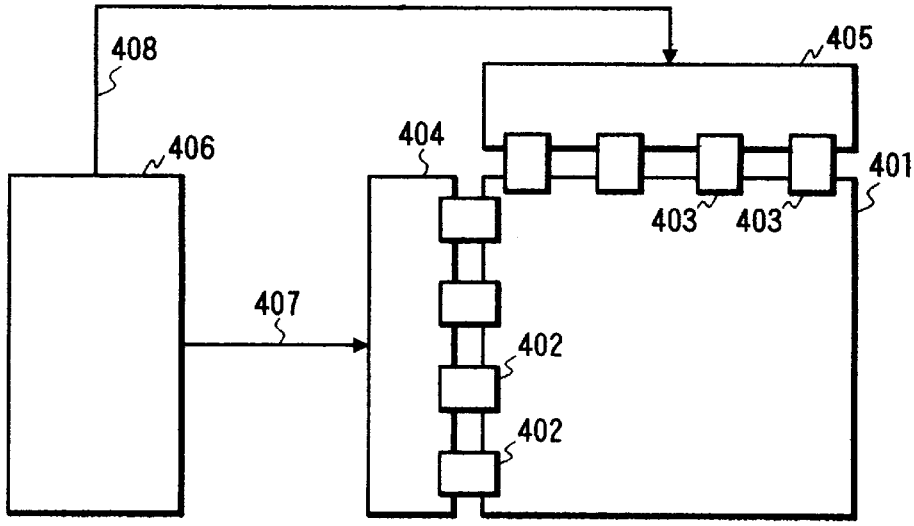
FIG. 5 is a physical schematic diagram showing the arrangement of a general image display apparatus.
Figure 6:
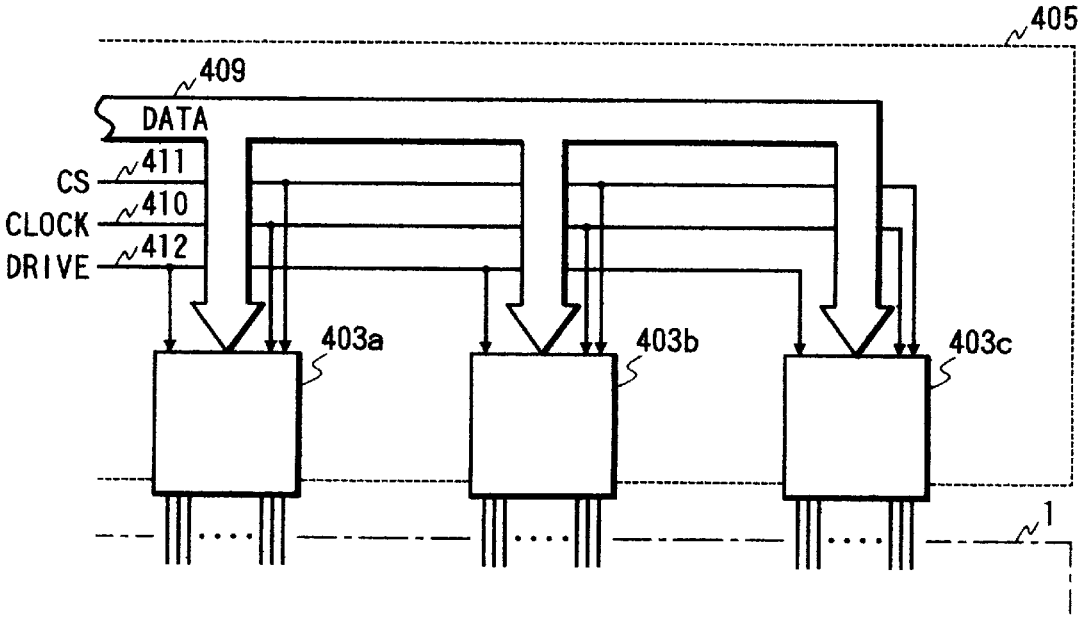
FIG. 6 is a block diagram showing the arrangement of conventional driving circuits in correspondence with FIG. 7.

The operation principle upon application of the driving circuit shown in FIGS. 38 and 39 to the image display apparatus shown in FIG. 5 will be explained below. Assume that the bus width of the image data bus 409 is 8 bits, and one driving circuit fetches image data for 160 clocks.

The start bit (SB) signal transferred from the controller 406 is input to the clock count number setting circuit 414 of each driving circuit. On the other hand, a load position (chip address) information 413 of each driving circuit, which is defined by the hardware pattern on the bus board 405, is input to the clock count number setting circuit 414. The clock count number setting circuit 414 calculates the timing, at which each driving circuit begins to fetch data, on the basis of the two different input signals. For example, the cases of the driving circuits 403*a* to 403*c* shown in FIG. 39 will be examined below. Upon reception of the start bit signal, the clock count number setting circuit 414 of the driving circuit 403*a* recognizes based on the mounting position information 413*a* on the bus board that image data after the start bit signal is that to be fetched by its own driving circuit, and the clock counter 415*a* immediately outputs an enable signal. Upon reception of the enable signal, the AND gate 416*a* generates a data fetching signal for the first latch circuit 417*a* in synchronism with a clock signal 410. Upon reception of the signal output from the AND gate 416*a*, the first latch circuit 417*a* sequentially fetches data from the data bus 409. This operation is completed when the clock counter 415*a* has counted 160 clocks and then resets the enable signal. Upon completion of storage of image data for 160 counts, the first latch circuit 417*a* transfers data toward the second latch circuit 418*a*, and the image data are held until the driving circuit receives a drive signal from the controller. When the start bit (SB) signal is input to the clock count number setting circuit 414*b*, the driving circuit 403*b* recognizes its own mounting position information 413*b*, and determines that the data starting from the 161st count after the start bit (SB) signal is input are image data to be fetched by itself. Then, the setting circuit 414*b* sets a count clock number "160" until the beginning of the fetching operation in the clock counter 415*b*. The clock counter 415*b* counts the set clock count number, and upon completion of the count operation, image data are sequentially fetched from the data bus 409 in the same procedure as in the driving circuit 403*a*. Thereafter, similar operations are performed in units of driving circuits. After image data are fetched by all the driving circuits, the controller inputs a drive signal to all the second latch circuits 418*a* to 418*c*, thereby simultaneously outputting data toward the display apparatus 401.

As described above, a start bit is assigned to the beginning of image data to be transferred from a controller 406, the hardware pattern used for recognizing the mounting position of each driving circuit by itself is arranged on the bus board 405, and the driving circuit itself determines the image data fetching timing based on this information, thereby obviating the need for CS signals from the controller. Thus, even when the number of driving circuits increases, the respective driving circuits can fetch image data without increasing the number of control signals such as CS signals.

Figure 41:
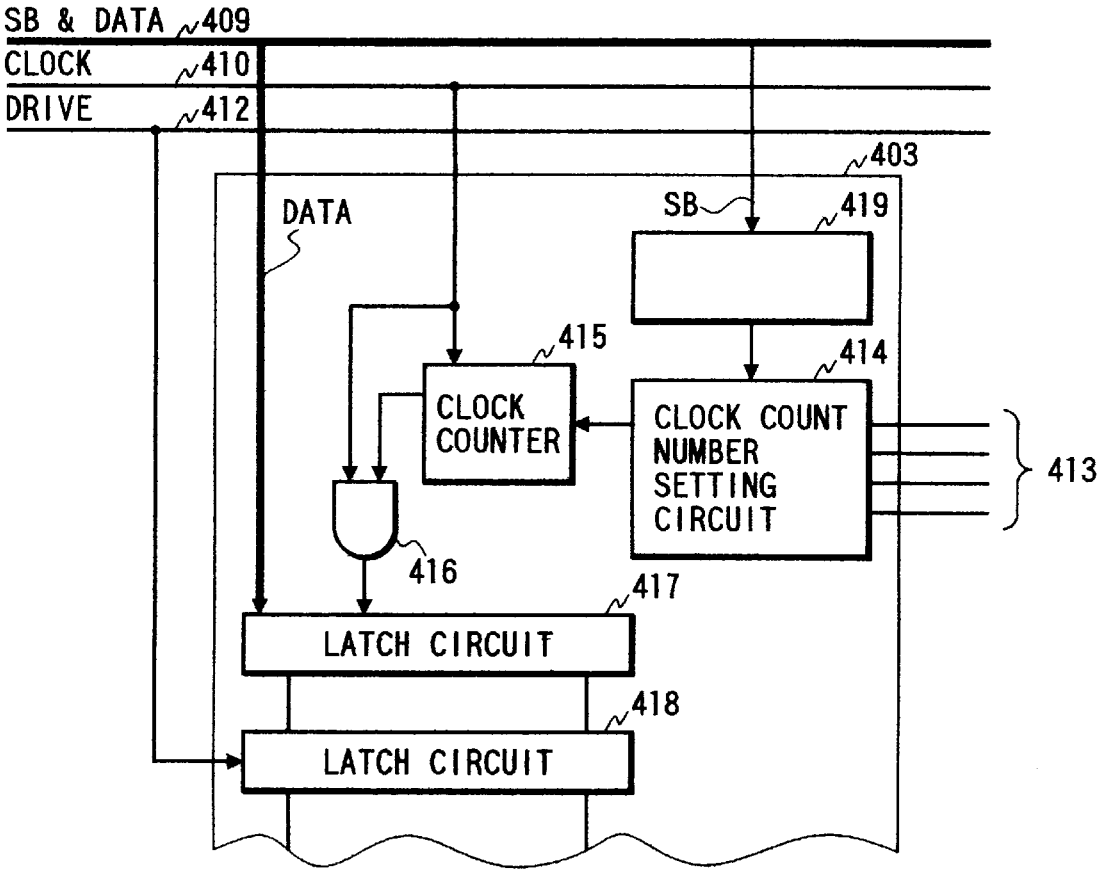
FIG. 41 is a block diagram showing the arrangement of a driving circuit according to the second embodiment of the present invention in correspondence with FIG. 39.

FIG. 41 shows the arrangement of a driving circuit according to a tenth embodiment of the present invention. The tenth embodiment is characterized in that, in addition to the embodiment shown in FIG. 41, a signal for designating a driving circuit that is to start the fetching operation of image data is set in the start bit signal, and an image data fetching start discrimination circuit 419 for discriminating which driving circuit starts the fetching operation or determining a clock count at which its own driving circuit starts the image data fetching operation is arranged before the clock count number setting circuit 414 in each driving circuit.

Upon reception of the start bit (SB) signal, the fetching start discrimination circuits 419 of all the driving circuits 403 discriminate which driving circuit is to start the fetching operation of transferred image data, and set the discriminated information in the next clock count number setting circuits 414. Each clock count number setting circuit 414 sets a clock number until the beginning of the fetching operation of image data from the data bus 409 in the clock counter 415 on the basis of the driving circuit information indicating the driving circuit which is to start the image data fetching operation and its own mounting position information 413 defined by the hardware pattern on the bus board 405. The following operations are the same as those in the first embodiment.

As described above, in addition to the effect described in the nineth embodiment, since the image data transfer operation from the controller is started from a portion that must be rewritten, image data transfer efficiency onto the data bus can be improved.

As described above, according to the present invention, a start bit is assigned to the beginning of image data to be transferred from the controller 406, the hardware pattern used for recognizing the mounting position of each driving circuit by itself is arranged on the bus board 405, and a circuit for determining the image data fetching timing of its own driving circuit on the basis of this information is arranged. Accordingly, it would be unnecessary to transmit CS signal from a controller. Thus, even when the number of driving circuits increases, a system for fetching image data into the respective driving circuits can be formed without increasing the number of control signals such as CS signals. In addition, since an increase in the number of control signal lines is suppressed, the present invention is also effective in terms of suppression of radiation noise and the like.

Furthermore, a signal for designating a driving circuit that is to start the fetching operation of image data is set in the start bit signal, and each driving circuit comprises, before the clock count number setting circuit, a circuit for discriminating the driving circuit that is to start the fetching operation of image data. Thus, since the controller starts the image data transfer operation from a portion that must be rewritten, image transfer efficiency onto the data bus can be improved.

What is claimed is:

1. A data transfer method for transferring data to an information-side driver for driving a display apparatus, wherein driver circuits each comprising a chip address/video data discrimination circuit and a unit driver are mounted around the display apparatus, said method comprising the steps of:

setting a unique chip address for each of the unit drivers by means of a hardware pattern; and exchanging data with the driver circuits so that chip address information and video data information are time-divisionally transferred to the target unit driver using a chip address/video data common bus line and a chip address/video discrimination control signal.

2. A method according to claim 1, further comprising the step of providing each of the driver circuits with an integrated circuit having the chip address/video data discrimination circuit and one unit driver, which comprises a chip address terminal defined by a plurality of pins.

3. A method according to claim 1, further comprising the step of providing each of the unit drivers with data latch means for holding previous data until the unit driver receives new data, and outputting data in accordance with the held data.

4. A method according to claim 1, wherein data of only the unit drivers, video data of which have changed, are transferred.

5. A method according to claim 4, wherein output pins of each of the unit drivers are divided into a plurality of blocks, and data of only blocks, video data of which have changed, are transferred.

6. A method according to claim 4, wherein only data between output pin blocks designated by start and end block signals, of output pins of each of the unit drivers are output.

7. A data transfer method for transferring data to an information-side driver for driving a display apparatus, wherein unit drivers each comprising a chip address/pin address discrimination circuit are mounted around the display apparatus, said method comprising the steps of:

setting a unique chip address for each of the unit drivers by means of a hardware pattern; and exchanging data with the unit drivers so that chip address information and pin address information are time-divisionally transferred to the target unit driver using a chip address/pin address common bus line and a chip address/pin address discrimination control signal.

8. A method according to claim 7, wherein each of said unit drivers comprises a chip address terminal defined by a plurality of pins.

9. A method according to claim 7, wherein the chip address information is sent by one clock.

10. A method according to claim 7, wherein the chip address information is sent by two clocks.

11. A data transfer method for transferring data to a driver for driving a display apparatus, wherein scanning- and information-side drivers are mounted around the display apparatus, said method comprising the steps of:

transferring data to the scanning- and information-side drivers using a common bus line on which information to the scanning-side driver and information to the information-side driver are transferred; and setting chip addresses of the scanning- and information-side drivers by hardware patterns.

12. A method according to claim 11, wherein the information to the scanning-side driver includes chip address information and pin address information.

13. A method according to claim 11, wherein the information to the information-side driver includes chip address information and video data information.

14. A method according to claim 11, wherein each of the scanning- and information-side drivers comprises a chip address terminal defined by a plurality of pins.

15. A method according to claim 11, further comprising the step of providing the information-side driver with latch means for holding previous data until the information-side driver receives new data and outputting data in accordance with the held data.

16. A method according to claim 11, wherein data of only the driver, video data of which has changed, are transferred.

17. A method according to claim 11, wherein drivers equivalent to the scanning- and information-side drivers are respectively arranged at four the of said display apparatus, and the common bus line is formed into a ring shape.

18. A data transfer method for driving a display apparatus, which comprises a controller for forming display apparatus driving information and a scanning-side driver for driving the display apparatus by receiving the driving information from said controller, said method comprising the steps of:

time-divisionally transferring chip address information and output pin address information of the scanning-side driver and control information as the driving information from the controller to scanning-side driver; and setting a chip address of the scanning-side driver by a hardware pattern.

19. A method according to claim 18, wherein the control information includes output waveform information.

20. A method according to claim 18, wherein the control information includes scanning mode information.

21. A method according to claim 18, further comprising the step of providing the scanning-side driver with latch means for holding previous output control information until the scanning-side driver receives new output control information, and outputting data in accordance with the held information.

22. A data transfer method for driving a display apparatus, which comprises a controller for forming display apparatus driving information and an information-side driver for driving the display apparatus by receiving the driving information from said controller, said method comprising the steps of:

time-divisionally transferring chip address information of the information-side driver, video data information, and control information using a bus line as the driving information from the controller to the information-side driver; and setting a chip address of the information-side driver by a hardware pattern.

23. A method according to claim 22, wherein the control information includes output waveform information.

24. A method according to claim 22, wherein the control information includes test mode information.

25. A method according to claim 24, further comprising the step of providing the information-side driver with latch means for holding previous output control information until the information-side driver receives new output control information, and outputting data in accordance with the held information.

26. A data transfer method for an image display apparatus comprising an image display unit, driving circuits for operating the image display unit, control means for generating a power supply signal and a control signal to be supplied to the driving circuits, a bus board for supplying the power supply signal and the control signal generated by the control means to the driving circuits, and transmission means for transmitting the power supply signal and the control signal generated by the control means to the bus board, said method comprising the steps of:

providing the apparatus with a data format in which a start bit indicating start of transfer is added to image data to be transferred from the control means; and providing the bus board with hardware patterns for recognizing mounting positions of the driving circuits, so that each of the driving circuits determines an image data fetching timing by itself.

27. A method according to claim 26, wherein information for designating the driving circuit which is to start a fetching operation of image data is assigned to the start bit.

28. A display apparatus comprising:

a display element;

a plurality of driving circuits for driving said element;

a circuit for supplying a driving circuit selection signal for selecting one of said plurality of driving circuits to said plurality of driving circuits via a common bus; and means, including a wiring pattern, for setting position information of said driving circuits.

29. An apparatus according to claim 28, wherein a driving information signal is supplied via said bus.

30. An apparatus according to claim 29, wherein the driving information signal is video data.

31. An apparatus according to claim 29, wherein the driving information signal is a scanning line selection signal.

32. An apparatus according to claim 29, wherein a control signal-for discriminating the driving information signal and the driving circuit selection signal from each other is supplied from a line different from said bus.

33. An apparatus according to claim 32, wherein the line supplies a 1-bit control signal.

34. An apparatus according to claim 32, wherein said bus has a bus width of not less than 16 bits.

35. An apparatus according to claim 28, wherein a block selection signal is supplied via said bus.

36. An apparatus according to claim 28, wherein scanning mode information is supplied via said bus.

37. An apparatus according to claim 28, wherein waveform data information is supplied via said bus.

38. An apparatus according to claim 28, wherein test mode information is supplied via said bus.

39. An apparatus according to claim 28, wherein a clock signal is supplied to said plurality of driving circuits via a different line, than said bus.

40. An apparatus according to claim 28, wherein a drive signal is supplied to said plurality of driving circuits via a different line, than said bus.

41. An apparatus according to claim 28, wherein each of said plurality of driving circuits comprises a 1-chip IC.

42. An apparatus according to claim 28, wherein each of said plurality of driving circuits comprises a latch circuit.

43. An apparatus according to claim 28, wherein each of said plurality of driving circuits comprises a position information detection circuit.

44. An apparatus according to claim 43, wherein said position information detection circuit comprises a clock count number setting circuit.

45. An apparatus according to claim 43, wherein said position information detection circuit comprises a comparator.

46. An apparatus according to claim 28, wherein each of said plurality of driving circuits comprises a decoder.

47. An apparatus according to claim 28, wherein each of said plurality of driving circuits comprises a logical product circuit for receiving an output from said bus and a control signal, a comparator for comparing an output from said logical product circuit and position information, and a logical product circuit for receiving an output from said comparator and the output from said bus.

48. An apparatus according to claim 28, wherein said plurality of driving circuits comprise two different types of 1-chip ICs.

49. An apparatus according to claim 48, wherein one type of said plurality of driving circuits is a scanning-side driver, and the other type of said plurality of driving circuits is an information-side driver.

50. An apparatus according to claim 49, wherein video data and a scanning line selection signal are time-serially transferred via said bus.

51. An apparatus according to claim 28, wherein said display element comprises an active matrix type liquid crystal element.

52. An apparatus according to claim 28, wherein said display element comprises a plasma display.

53. An apparatus according to claim 28, wherein said display element comprises an electron emission element.

54. An apparatus according to claim 28, wherein said display element comprises a ferroelectric liquid crystal element.

55. A display apparatus, comprising:

a display element;

a plurality of driving circuits for driving said display element;

a common wiring board connected to said plurality of driving circuits;

a circuit for time-serially supplying a driving circuit selection signal for selecting one of said plurality of driving circuits and a driving information signal to be supplied to said selected driving circuit to said plurality of driving circuits via a bus on said common wiring board; and a hardware pattern, including wiring, to set a chip address of each of said plurality of driving circuits.

56. An apparatus according to claim 55, wherein each of said driving circuits comprises a circuit for detecting position information of said driving circuit.

57. An apparatus according to claim 55, wherein said bus further transfers one of scanning mode information, waveform data information, and test mode information.

58. A display apparatus, comprising:

a display element;

a plurality of driving circuits for driving said display element:

a common wiring board connected to said plurality of driving circuits;

a circuit for time-serially supplying a scanning line information signal for selecting a scanning line and display data to be supplied to an information line to said plurality of driving circuits via a bus on said common wiring board; and a hardware pattern, including wiring, to set a chip address of each of said plurality of driving circuits.

59. An apparatus according to claim 58, wherein a driving circuit selection signal for said plurality of driving circuits is supplied via said bus.

60. An apparatus according to claim 58, wherein each of said plurality of driving circuits comprises a circuit for detecting position information of the driving circuit.

61. A display apparatus; comprising:

a display element;

a plurality of driving circuits for driving said display element;

a common wiring board connected to said plurality of driving circuits; and means, arranged on said common wiring board and including a wiring pattern, for specifying position information of each of said plurality of driving circuits, wherein said means comprises a wiring pattern.

62. An apparatus according to claim 61, wherein each of said driving circuits comprises a circuit for detecting a driving circuit selection signal.

63. An apparatus according to claim 61, wherein each of said driving circuits processes a driving information signal on the basis of a driving circuit selection signal and the position information.

64. An apparatus according to claim 55 or 61, wherein said plurality of driving circuits comprise information-side drivers.

65. An apparatus according to claim 55, wherein the driving information signal is video data.

66. An apparatus according to any one of claims 55, 58, and 61, wherein each of said plurality of driving circuits comprises a decoder and a latch circuit.

67. An apparatus according to any one of claims 55, 58, and 61, wherein a control signal for discriminating the driving circuit selection signal and the driving information signal from each other is supplied via a 1-bit line on said common wiring board.

68. An apparatus according to any one of claims 55, 58, and 61, further comprising a circuit for comparing the driving circuit selection signal and said position information of the driving circuit.

69. An apparatus according to any one of claims 55, 58, and 61, wherein an electrical circuit for specifying the position information of each of said plurality of driving circuits is arranged on said common wiring board.

70. An apparatus according to claim 55 or 61, wherein said plurality of driving circuits comprise scanning-side drivers.

71. An apparatus according to any one of claims 55, 58, and 61 wherein said plurality of driving circuits comprise scanning- and information-side drivers.

72. An apparatus according to claim or 55 or 58, wherein the driving information signal is a scanning line selection signal.

73. An apparatus according to claim 55 or 58, wherein the driving information signal includes a scanning line information signal and video data.

74. An apparatus according to any one of claims 55, 58, and 61, wherein a control signal for discriminating the driving circuit selection signal and a scanning line information signal from each other is supplied to said plurality of driving circuits via a 1-bit line on said common wiring board.

75. An apparatus according to any one of claims 55, 58, and 61, wherein block selection information for selecting an information line block in each of said plurality of driving circuits is supplied in parallel with the driving circuit selection signal.

76. An apparatus according to any one of claims 55, 58, and 61, wherein said common wiring board comprises a multi-layered wiring board.

77. An apparatus according to any one of claims 55, 58, and 61, wherein each of said plurality of driving circuits comprises a 1-chip IC.

78. An apparatus according to any one of claims 55, 58, and 61, wherein each of said plurality of driving circuits comprises a tape-carrier-packaged 1-chip IC.

79. An apparatus according to any one of claims 55, 58, and 61, wherein said plurality of driving circuits are arranged on at least two neighboring sides of said display element having a rectangular shape.

80. An apparatus according to any one of claims 55, 58 and 61, wherein said plurality of driving circuits are arranged on three sides of said display element having a rectangular shape.

81. An apparatus according to any one of claims 55, 58, and 61, wherein said display element comprises one of a liquid crystal panel, a plasma display panel, an electron emission element, and a digital micro-mirror device.

82. An apparatus according to any one of claims 55, 58, and 61, wherein said display element comprises one of an active matrix type liquid crystal element and a ferroelectric liquid crystal element.

83. An apparatus according to any one of claims 55, 58, and 61, wherein said wiring pattern is applied with one of a first reference potential and a second reference potential different from the first reference potential.

84. A data transfer method for driving a display apparatus, which comprises a controller forming display apparatus driving information, a scanning-side driver for driving the display apparatus by receiving the driving information from the controller and an information-side driver for driving the display apparatus by receiving the driving information from the controller, said method comprises the steps of:

setting chip addresses of the scanning-side driver and the information-side driver by a hardware pattern;

time-divisionally transferring chip address information and output pin address information of the scanning-side driver and control information as the driving information from the controller to the scanning-side driver; and time-divisionally transferring chip address information of the information-side driver, video data information, and control information using a bus line as the driving information from the controller to the information-side driver.

* * * * *

UNITED STATES PATENT AND TRADEMARK OFFICE

CERTIFICATE OF CORRECTION

PATENT NO. : 6,078,318

DATED : June 20, 2000

INVENTOR(S): HIDEO MORI, ET AL.

It is certified that error appears in the above-identified patent and that said Letters Patent is hereby corrected as shown below:

COLUMN 18:

Line 61, "the of said" should read --sides of the--.

COLUMN 19:

Line 33, "claim 24," should read --claim 22,--.

COLUMN 20:

Line 8, "signal-for" should read --signal for--.
Line 25, "line," should read --line--.
Line 28, "line," should read --line--.

Signed and Sealed this

Eighth Day of May, 2001

*Attest:*

Nicholas P. Godici

NICHOLAS P. GODICI

*Attesting Officer*

*Acting Director of the United States Patent and Trademark Office*